US011097822B2

(12) United States Patent
Aoki et al.

(10) Patent No.: US 11,097,822 B2
(45) Date of Patent: Aug. 24, 2021

(54) UNDERWATER PROPULSIVE DEVICE OF WATERCRAFT

(71) Applicant: Yanmar Co., Ltd., Osaka (JP)

(72) Inventors: Hideaki Aoki, Osaka (JP); Takeshi Ouchida, Osaka (JP)

(73) Assignee: YANMAR POWER TECHNOLOGY CO., LTD., Osaka (JP)

( * ) Notice: Subject to any disclaimer, the term of this patent is extended or adjusted under 35 U.S.C. 154(b) by 0 days.

(21) Appl. No.: 16/485,394

(22) PCT Filed: Feb. 8, 2018

(86) PCT No.: PCT/JP2018/004461
§ 371 (c)(1),
(2) Date: Aug. 12, 2019

(87) PCT Pub. No.: WO2018/147386
PCT Pub. Date: Aug. 16, 2018

(65) Prior Publication Data

US 2019/0389551 A1 Dec. 26, 2019

(30) Foreign Application Priority Data

Feb. 13, 2017 (JP) ..... JP2017-024096

(51) Int. Cl.
*B63H 11/08* (2006.01)
*B63B 34/00* (2020.01)

(52) U.S. Cl.
CPC ..... *B63H 11/08* (2013.01); *B63B 34/00* (2020.02)

(58) Field of Classification Search
CPC .... B63B 1/00; B63B 1/16; B63B 1/18; B63B 1/24; B63B 1/242; B63B 1/246;
(Continued)

(56) References Cited

U.S. PATENT DOCUMENTS 2,906,228 A * 9/1959 Hermann ..... B63B 1/285 114/280
3,623,444 A * 11/1971 Lang ..... B63B 1/107 114/277

(Continued)

FOREIGN PATENT DOCUMENTS

JP 6-159055 A 6/1994
JP 8-239090 A 9/1996

(Continued)

OTHER PUBLICATIONS

International Search Report dated Apr. 10, 2018 issued in corresponding PCT Application PCT/JP2018/004461 cites the patent documents above.

*Primary Examiner* — Daniel V Venne
(74) *Attorney, Agent, or Firm* — Norton Rose Fulbright US LLP

(57) ABSTRACT

An underwater propulsive device of a watercraft including a flotation unit on which a user rides. The propulsion device includes: a hollow body coupled to the flotation unit through a strut and extending in a propulsive direction of the watercraft, the inside of the hollow body being divided into a first compartment and a second compartment; a motor in the first compartment; a propeller in the second compartment; and a power transfer shaft extending in the propulsive direction and connecting the motor and the propeller to each other. The first compartment has a waterproof structure. The second compartment has a water inlet disposed closer to the bow than the propeller is and extending along a circumference of the power transfer shaft and a water jet outlet disposed at a stern-side end of the second compartment. The propeller is smaller than the first compartment in diameter.

20 Claims, 15 Drawing Sheets

(58) Field of Classification Search
CPC ..... B63B 1/248; B63B 1/26; B63B 35/73; B63B 39/06; B63B 41/00; B63H 11/00; B63H 11/02; B63H 11/04; B63H 11/08; B63H 11/081; B63H 11/10; B63H 11/102
USPC ..... 440/38, 40, 46, 66, 67, 75, 76, 82; 114/20.1, 20.2, 25, 39.15, 55.54, 274, 114/278, 312, 313, 315, 330, 337, 338; 441/65, 74, 79
See application file for complete search history.

(56) References Cited

U.S. PATENT DOCUMENTS

| | | | | |
|---|---|---|---|---|
| 5,253,603 | A | 10/1993 | Mascolo | |
| 7,984,684 | B2 * | 7/2011 | Hinderks | F02B 77/13 114/274 |
| 9,359,044 | B2 | 6/2016 | Langelaan | |
| 2011/0263168 | A1 | 10/2011 | Adams | |
| 2016/0185430 | A1 | 6/2016 | Langelaan | |

FOREIGN PATENT DOCUMENTS

| | | | |
|---|---|---|---|
| JP | 2007-276609 | A | 10/2007 |
| JP | 2016-523769 | A | 8/2016 |

* cited by examiner

UNDERWATER PROPULSIVE DEVICE OF WATERCRAFT

CROSS REFERENCES TO RELATED APPLICATIONS

This application is a national stage application pursuant to 35 U.S.C. § 371 of International Application No. PCT/JP2018/004461, filed on Feb. 8, 2018 which claims priority under 35 U.S.C. § 119 to Japanese Patent Application No. 2017-024096 filed on Feb. 13, 2017, the disclosures of which are hereby incorporated by reference in their entireties.

TECHNICAL FIELD

The present disclosure relates to an underwater propulsive device of a watercraft, and particularly to an underwater propulsive device of a watercraft including a flotation unit on which a user rides.

BACKGROUND ART

Watercrafts such as a surfboard and a wind surfboard for sports and leisure are propelled by using natural forces such as waves and wind, and are operated by a weight shift of a user. A known configuration of such a watercraft includes a propulsive device in order to enhance mobility.

For example, Patent Literatures 1 and 2 (PTLs 1 and 2) disclose watercrafts each including a flotation unit on which a user rides, a hydrofoil disposed below the flotation unit, a strut that connects the hydrofoil to the flotation unit, a propeller, a motor that rotates the propeller, a controller that controls a rotation speed of the motor, a battery that supplies the motor with electric power, and so forth. In the watercrafts of PTLs 1 and 2, the propeller and the motor are attached to the hydrofoil, and the controller and the battery are disposed on the flotation unit.

CITATION LIST

Patent Literature

PTL 1: U.S. Pat. No. 9,359,044

PTL 2: U.S. Patent Application Publication No. 2016/0185430

SUMMARY OF INVENTION

Technical Problem

PTLs 1 and 2 do not disclose a specific configuration for the propulsive device including the propeller. The propeller disclosed in PTLs 1 and 2 has an outer diameter larger than the diameter of a case in which the motor is housed. Thus, a heavy load might be applied to the motor.

An object of some aspects of the present disclosure is to provide an underwater propulsive device of a watercraft in which a load on a motor is reduced.

Solution to Problem

An aspect of the present disclosure provides an underwater propulsive device of a watercraft including a flotation unit on which a user rides, and the underwater propulsive device includes: a hollow body coupled to the flotation unit through a strut and extending in a propulsive direction, inside of the body being divided into a first compartment at a bow side of the body and a second compartment at a stern side of the body; a motor housed in the first compartment; a propeller housed in the second compartment; and a power transfer shaft extending in the propulsive direction and connecting the motor and the propeller to each other, wherein the first compartment has a waterproof structure, the second compartment has a water inlet disposed closer to a bow than the propeller is and extending along a circumference of the power transfer shaft and a water jet outlet disposed at a stern-side end of the second compartment, and the propeller has an outer diameter smaller than a diameter of the first compartment (first configuration).

The underwater propulsive device may further include a motor driving circuit, and the motor driving circuit may be housed in the first compartment at a location closer to the bow than the motor is (second configuration).

The underwater propulsive device may further include a cooling water passage having a suction port and a discharge port and passing through the first compartment, and the discharge port may communicate with the water inlet (third configuration).

The water inlet may be covered with a filter that prevents or reduces entering of foreign matter into the second compartment (fourth configuration).

The first compartment may be constituted by a bow portion, a cylindrical barrel portion, and a lid portion, the second compartment may be constituted by a stern portion whose bow-side end is fitted to the lid portion, the bow portion is fitted to a bow-side end of the barrel portion with a sealing member interposed therebetween, the lid portion may be fitted to a stern-side end of the barrel portion with a sealing member interposed therebetween, the bow portion and the lid portion may be fixed to the barrel portion by a fastening force exerted in a cylinder axis direction of the barrel portion, and the stern portion may be fixed to the lid portion by a fastening force exerted in the cylinder axis direction of the barrel portion (fifth configuration).

The bow portion may include a detachable bow hydrofoil, and the stern portion may include a detachable stern hydrofoil (sixth configuration).

The stern hydrofoil may be coupled to and interlocked with a water surface sensor attached to the strut and swing upward and downward in accordance with an operation of the water surface sensor (seventh configuration).

The motor may be fixed to the lid portion with a coupling member interposed therebetween (eighth configuration).

Advantageous Effects of Invention

With the first configuration, the outer diameter of the propeller is smaller than the diameter of the first compartment housing the motor, and thus, a load to the motor can be reduced.

With the second configuration, the motor, the motor driving circuit, and the propeller are arranged side by side along the propulsive direction. Accordingly, dimensions of the body in the top-bottom directions and the left-right directions can be reduced so that a propulsive resistance of the underwater propulsive device can be reduced.

With the third configuration, the motor driving circuit and the motor can be cooled with a simple configuration.

With the fourth configuration, damage caused by sucking of foreign matter can be prevented or reduced so that durability of the underwater propulsive device can be enhanced.

With the fifth configuration, a waterproof property of the first compartment can be obtained with a simple configuration so that productivity of the underwater propulsive device can be enhanced.

With the sixth configuration, portability of the watercraft can be enhanced.

With the seventh configuration, traveling of the watercraft with the flotation unit floating above the water surface can be stabilized.

With the eighth configuration, hermeticity of the first compartment can be enhanced, and productivity of the underwater propulsive device can be enhanced.

DESCRIPTION OF EMBODIMENT

Figure 1:
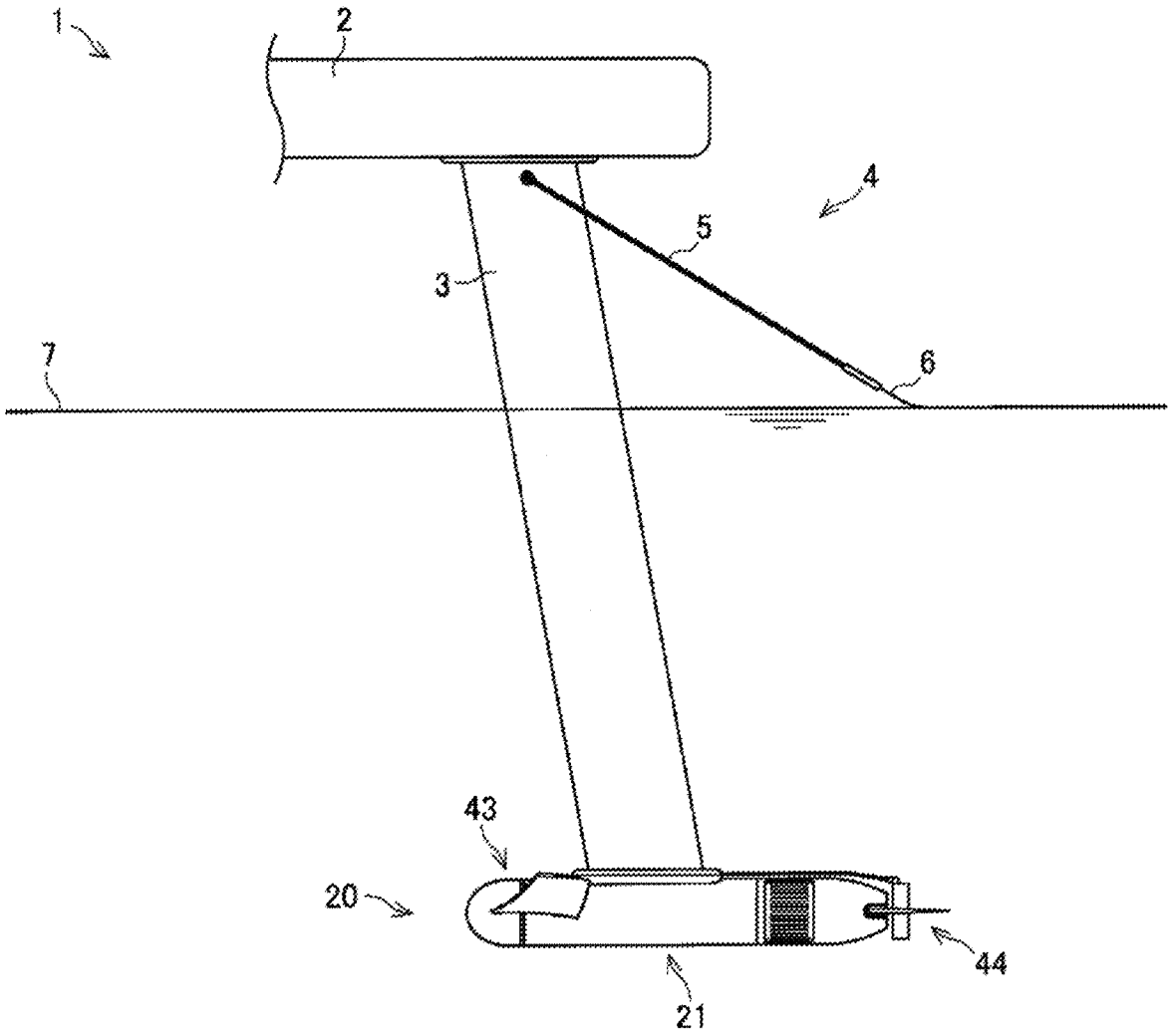
FIG. 1 A side view illustrating a watercraft including an underwater propulsive device as an example of an embodiment of the present disclosure.

An embodiment of the present disclosure will be described in detail with reference to the drawings. First, a configuration of a watercraft 1 including an underwater propulsive device 20 according to this embodiment will be described in detail. FIG. 1 is a side view illustrating the watercraft 1 including the underwater propulsive device 20 as an example of an embodiment of the present disclosure. In the following description, the leftward direction in FIG. 1, which is the propulsive direction of the underwater propulsive device 20 (traveling direction of the watercraft 1), will be referred to as a bow direction and the rightward direction will be referred to as a stern direction, for convenience of description. A direction toward the front of the drawing sheet of FIG. 1 that is orthogonal to the propulsive direction and horizontal will be referred to as the leftward direction, and a direction toward the depth of the drawing sheet will be referred to as a rightward direction. A direction toward the top in the drawing sheet of FIG. 1 that is orthogonal to the propulsive direction and vertical will be referred to as upward, and a direction toward the bottom will be referred to as downward. In FIG. 1, the watercraft 1 is in a traveling state, and a bow side of a flotation unit 2 described later is not shown.

As illustrated in FIG. 1, the watercraft 1 includes the flotation unit 2, the underwater propulsive device 20, a bow hydrofoil 43, a stern hydrofoil 44, and a water surface sensor 4. The underwater propulsive device 20 is coupled to the flotation unit 2 through a strut 3. The water surface sensor 4 is attached to the strut 3. Although not shown in FIG. 1, the watercraft 1 may further include a battery, an operation tool for operating the underwater propulsive device 20, a control unit for controlling the underwater propulsive device 20, and so forth.

The watercraft 1 is used in the water. A user rides on the upper surface of the flotation unit 2. The underwater propulsive device 20 is disposed below the flotation unit 2 in the water. The watercraft 1 travels in the bow direction by a propulsive force of the underwater propulsive device 20.

The flotation unit 2 is a plate-shaped member extending in the traveling direction. Examples of a material for the flotation unit 2 include materials that cause buoyancy to water, such as a foaming resin generated by adding a foaming agent to a synthetic resin exemplified by polyurethane and polystyrene, and are not limited to specific materials. The flotation unit 2 incorporates a battery and a control unit, for example, that are subjected to a waterproof treatment, and the operation tool is attached to the flotation unit 2. The waterproof treatment is not limited to a specific method. For example, components such as the battery and the control unit may be housed in a housing with a waterproof structure using, for example, a gasket.

The battery is a rechargeable secondary battery, and supplies direct current (DC) power. The voltage of DC power from the battery is, for example, about 30 V to 60 V. The battery may be, for example, a lead-acid battery or a lithium ion battery.

Examples of the operation tool include a structure in which a waterproof pressing-type switch is attached to a grip to be grasped by a user. The flotation unit 2 is configured to have buoyancy not to sink under water when a user rides thereon. The flotation unit 2 may be a known unit such as a surfboard, a body board, a paddle board, or a wind surfboard.

The strut 3 is a cylindrical member extending upward and downward. The strut 3 has, for example, a streamline shape which is narrow laterally (left-right direction) and whose horizontal cross section extends in the traveling direction. Examples of a material for the strut 3 include a lightweight material having high strength, such an aluminium alloy exemplified by duralumin, and are not limited to a specific material. The upper end of the strut 3 is fixed to the lower surface of the flotation unit 2. The underwater propulsive device 20 is attached to the lower end of the strut 3.

The water surface sensor 4 includes a bar 5 and a contact plate 6. The bar 5 extends in the traveling direction. The front end of the bar 5 is attached to a portion of the strut 3 near the upper end thereof to be rotatable upward and downward. The contact plate 6 is attached to the rear end of the bar 5.

The water surface sensor 4 pivots downward by its own weight while the watercraft 1 travels with the flotation unit 2 floating above a water surface 7. Accordingly, the contact plate 6 is brought into contact with the water surface 7. The water surface sensor 4 is configured to detect the distance between the flotation unit 2 and the water surface 7 based on the amount of pivot with respect to the strut 3. Examples of materials for the bar 5 and the contact plate 6 include stainless steel, and are not limited to specific materials.

Figure 2:
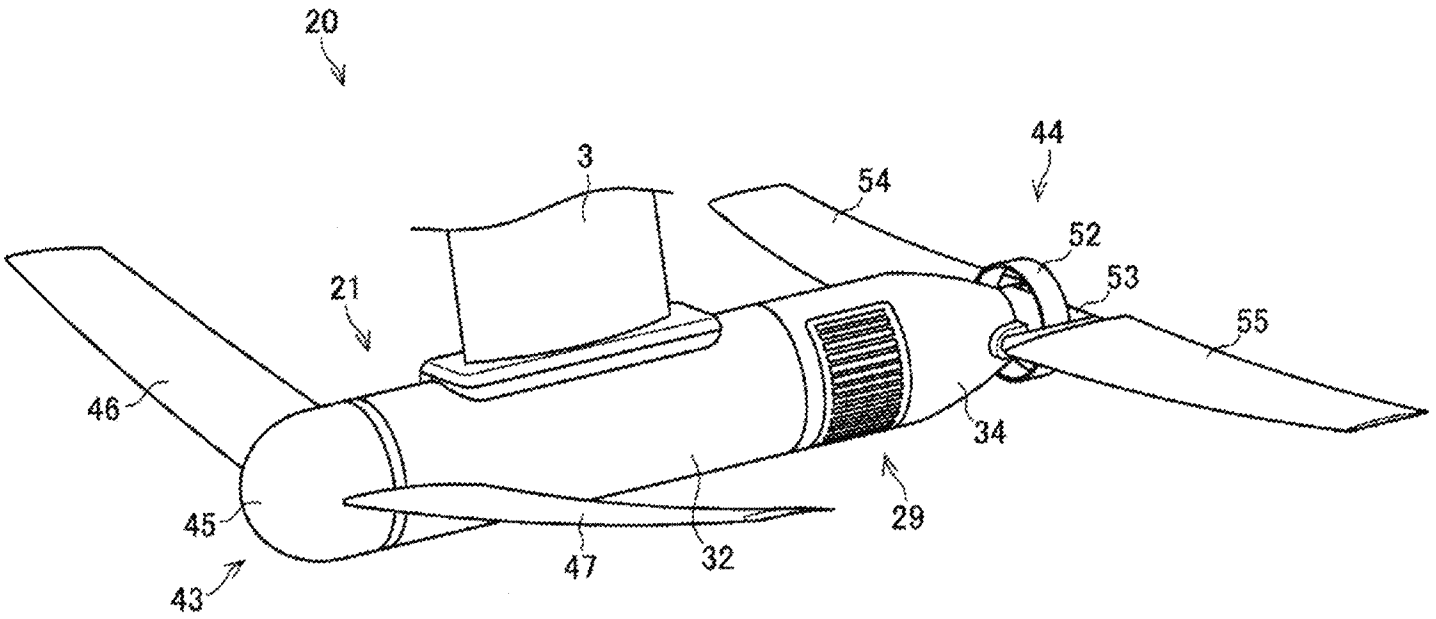
FIG. 2 A perspective view of the underwater propulsive device.
Figure 3:
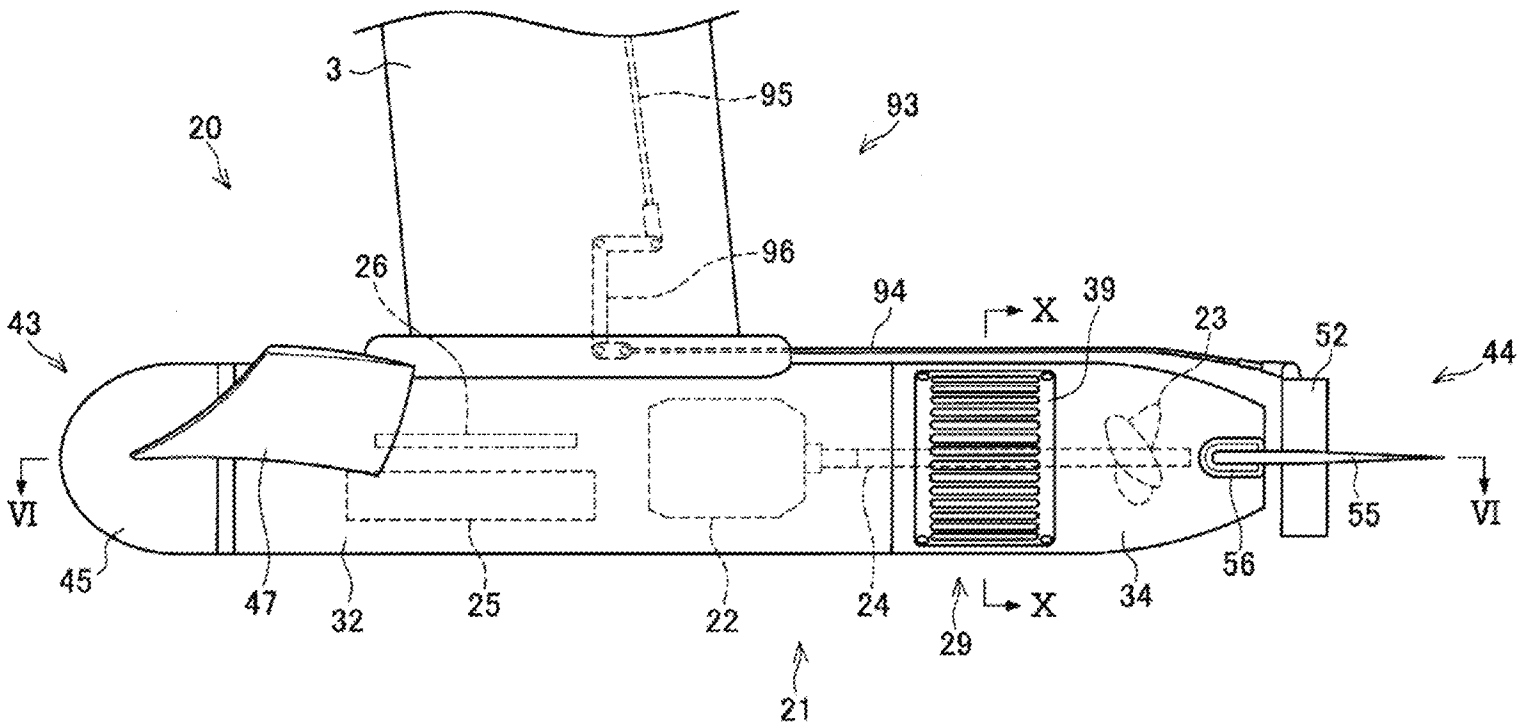
FIG. 3 A side view of the underwater propulsive device.
Figure 4:
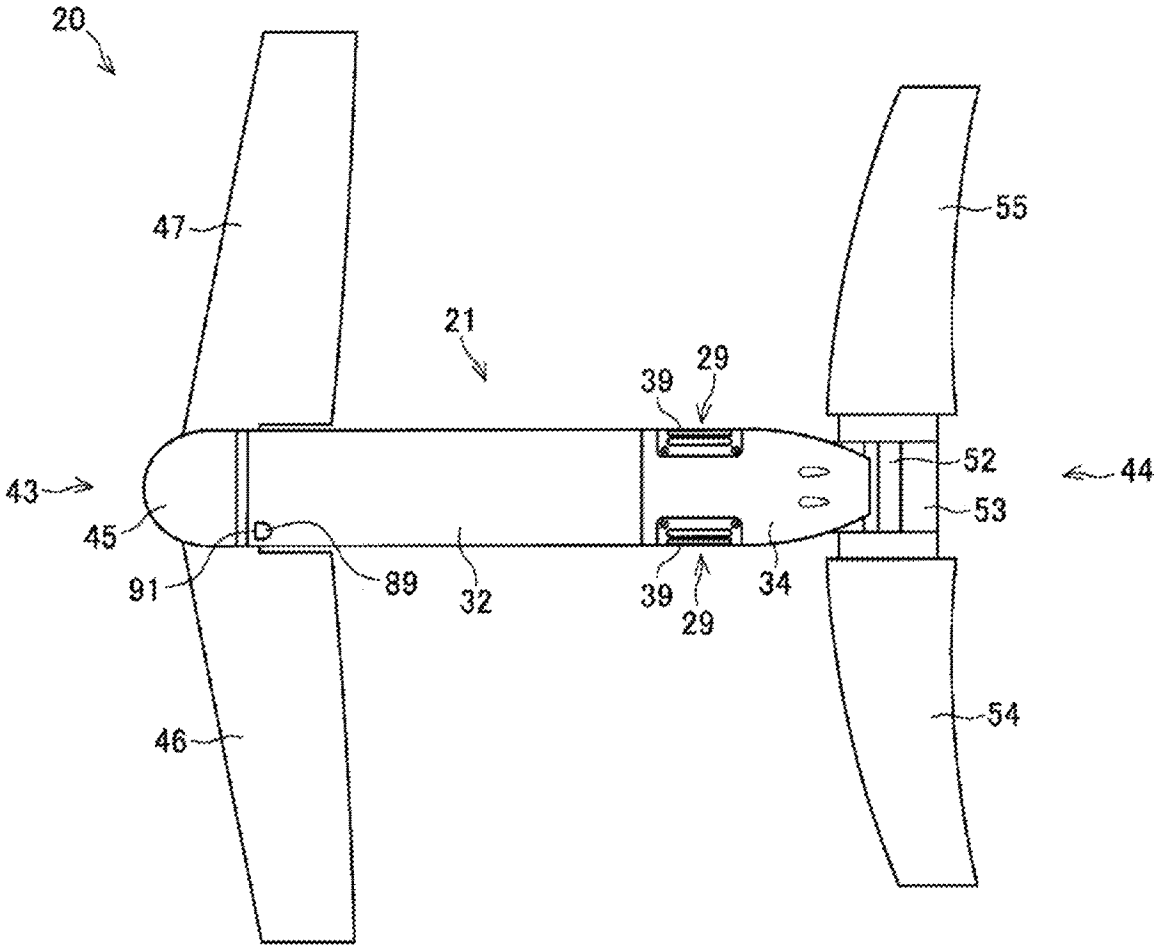
FIG. 4 A bottom view of the underwater propulsive device.
Figure 5:
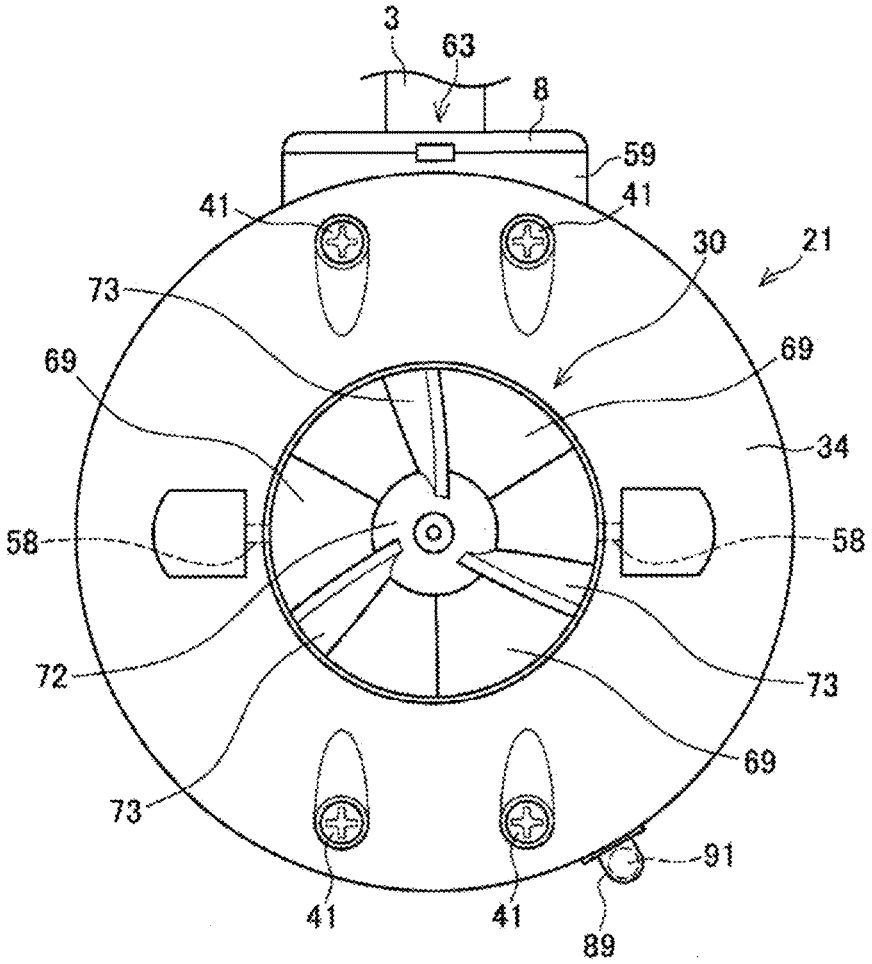
FIG. 5 A rear view of the underwater propulsive device.
Figure 6:
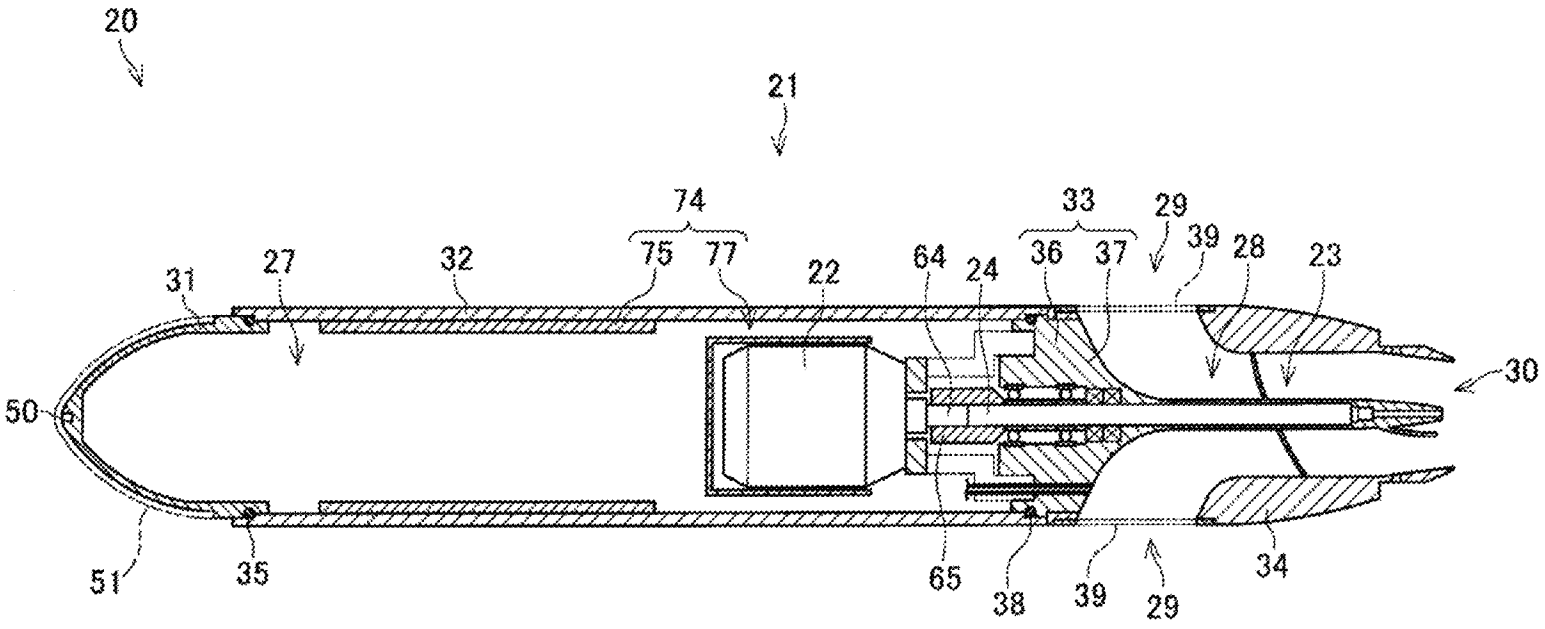
FIG. 6 A cross-sectional view taken along line VI-VI in FIG. 3.
Figure 7:
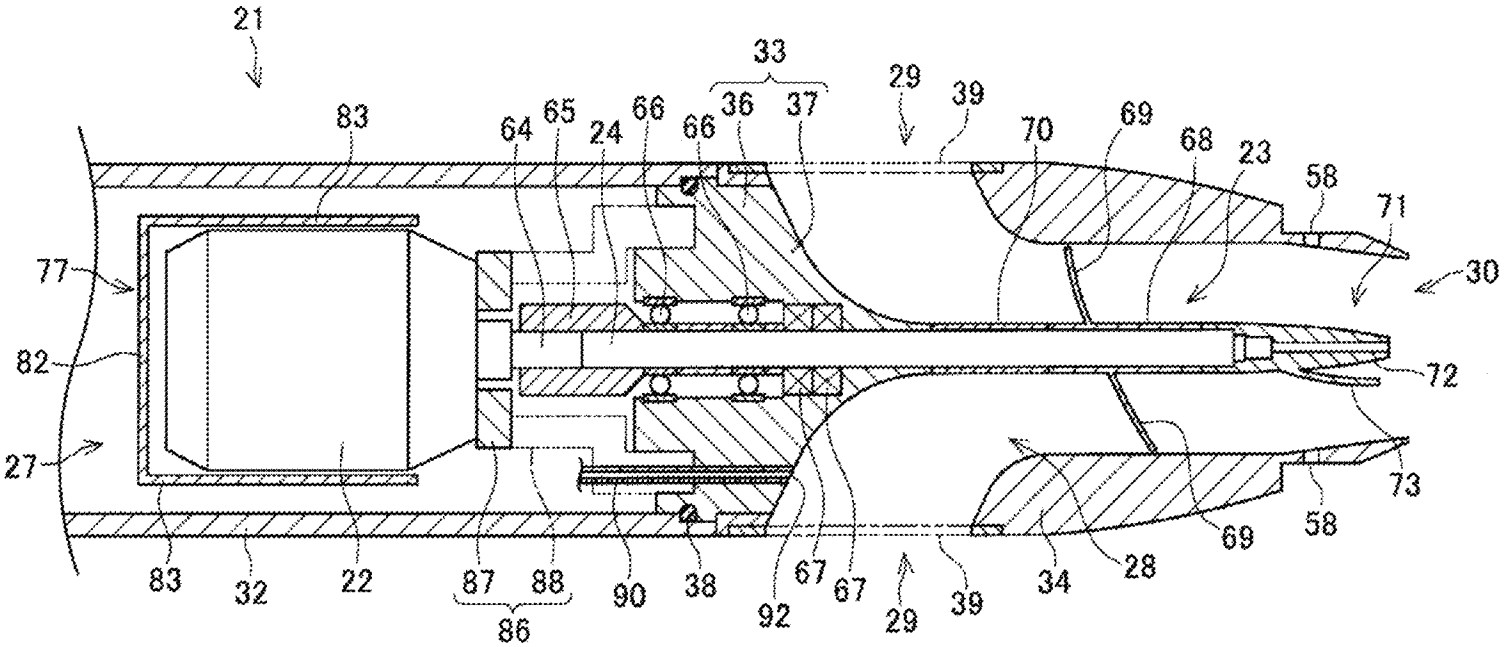
FIG. 7 An enlarged view of a stern side illustrated in FIG. 6.

A configuration of the underwater propulsive device 20 according to this embodiment will now be described in detail. FIG. 2 is a perspective view of the underwater propulsive device 20. FIG. 3 is a side view of the underwater propulsive device 20. FIG. 4 is a bottom view of the underwater propulsive device 20. FIG. 5 is a rear view of the underwater propulsive device 20. FIG. 6 is a cross-sectional view taken along line VI-VI in FIG. 3. FIG. 7 is an enlarged view of a stern side in FIG. 6. FIG. 2 is a perspective view of the underwater propulsive device 20 when seen from obliquely above the bow side. In FIG. 3, line VI-VI is a straight line passing through the center of the underwater propulsive device 20 and extending horizontally. FIG. 6 is a horizontal cross-sectional view of the underwater propulsive device 20. FIG. 5 does not show the bow hydrofoil 43 and the stern hydrofoil 44, for example. FIGS. 6 and 7 do not show the bow hydrofoil 43, the stern hydrofoil 44, an inverter 25 described later, a control unit 26, and pipes serving as cooling water passages, for example. In FIGS. 6 and 7, a motor 22 described later and a power transfer shaft 24 are shown not in a cross section but in a plan view.

As illustrated in FIGS. 2 and 3, the underwater propulsive device 20 includes a body 21, the motor 22, a propeller 23, the power transfer shaft 24, the inverter 25, and the control unit 26. The body 21 extends in a propulsive direction. The body 21 has a hollow shape. The power transfer shaft 24 connects the motor 22 and the propeller 23 to each other. In this embodiment, the inverter 25 corresponds to a motor driving circuit.

As illustrated in FIG. 6, the inside of the body 21 is divided into a first compartment 27 at the bow side and a second compartment 28 at the stern side. The first compartment 27 has a waterproof structure. The first compartment 27 houses, for example, the motor 22, the inverter 25, and the control unit 26. The second compartment 28 houses the propeller 23. The second compartment 28 includes a water inlet 29 and a water jet outlet 30. The water inlet 29 is located closer to the bow than the propeller 23 is in the second compartment 28. The water jet outlet 30 is formed at the stern-side end of the second compartment 28. The underwater propulsive device 20 is configured such that the propeller 23 is rotated by the motor 22 to suck water in the second compartment 28 through the water inlet 29 and eject water from the water jet outlet 30 to thereby generate a propulsive force in the bow direction.

Figure 8:
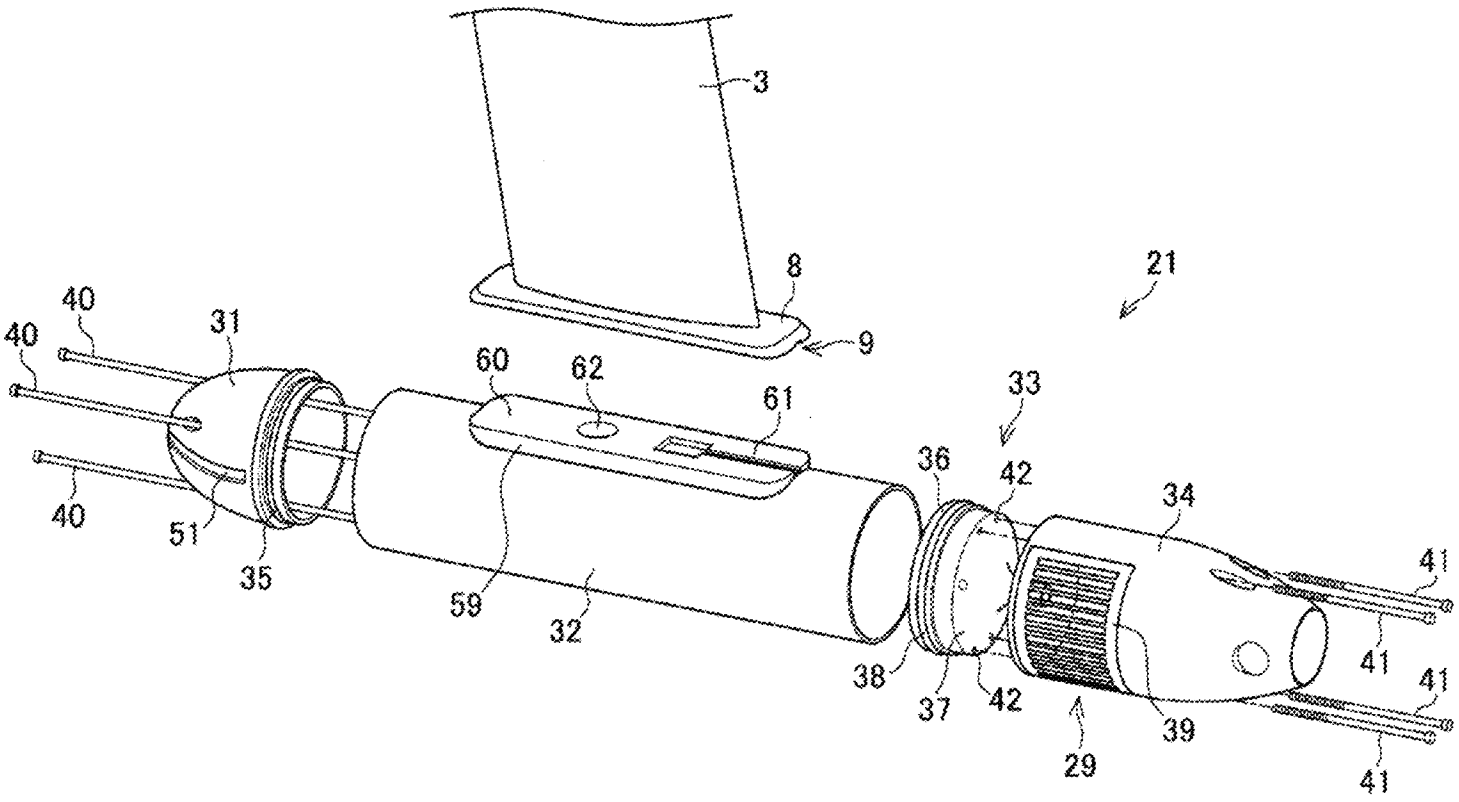
FIG. 8 A disassembled perspective view illustrating a body of the underwater propulsive device.

As illustrated in FIGS. 6, 7, and 8, the body 21 includes a bow portion 31, a barrel portion 32, a lid portion 33, and a stern portion 34. FIG. 8 is a disassembled perspective view illustrating a configuration of the body 21 and is a disassembled perspective view of the body 21 when seen from obliquely above the stern side. In the body 21 illustrated in FIG. 8, the bow portion 31, the barrel portion 32, the lid portion 33, and the stern portion 34 are separated from one another. In the illustration of FIG. 8, a lower end of the strut 3 is also separated from the other members. FIG. 8 does not show members housed in the body 21, such as the motor 22, the propeller 23, and the power transfer shaft 24.

The bow portion 31 has a hollow shape that is open at the stern-side end. The bow portion 31 has a bullet shape tapered toward the bow, for example. The stern-side end of the bow portion 31 is fitted to the bow-side end of the barrel portion 32 with a sealing member 35 interposed therebetween.

The barrel portion 32 has a cylindrical shape. The barrel portion 32 has a substantially uniform diameter and extends in the traveling direction of the underwater propulsive device 20.

The lid portion 33 includes a fitting part 36 and a projecting part 37. The fitting part 36 has a columnar shape. The projecting part 37 has a substantially conical shape. The diameter of the projecting part 37 decreases from the fitting part 36 toward the stern. The bow side of the fitting part 36 is fitted to the stern-side end of the barrel portion 32 with a sealing member 38 interposed therebetween.

The stern portion 34 has a substantially cylindrical shape. The outer diameter of the bow-side end of the stern portion 34 is substantially equal to the outer diameter of the barrel portion 32. The outer diameter of the stern portion 34 at the stern side gradually decreases toward the stern. The bow-side end of the stern portion 34 is fitted to the stern side of the fitting part 36 of the lid portion 33. At this time, the projecting part 37 of the lid portion 33 is inserted in the stern portion 34.

The inside of the body 21 is divided into the first compartment 27 at the bow side and the second compartment 28 at the stern side by the lid portion 33. The first compartment 27 is constituted by the bow portion 31, the columnar barrel portion 32, and the lid portion 33. The bow portion 31 is fitted to the columnar barrel portion 32 with the sealing member 35 interposed therebetween. The lid portion 33 is fitted to the barrel portion 32 with the sealing member 38 interposed therebetween. In this manner, the first compartment 27 is configured to have a waterproof structure. The sealing members 35 and 38 are not limited to O-rings, and may be, for example, rubber sheets.

The second compartment 28 is constituted by the stern portion 34. The stern portion 34 includes the water inlet 29 that is rectangular in a side view at each of the left and right of the bow-side end portion. The water inlet 29 is covered with a filter 39. The filter 39 includes a plurality of slits extending in the propulsive direction. The filter 39 is curved in an arc shape along the contour of the stern portion 34, for example. The outer diameter of the stern portion 34 gradually decreases from a portion closer to the stern than the water inlet 29 is, in the stern direction. The stern portion 34 has the water jet outlet 30 at the stern-side end. The water jet outlet 30 has a circular shape in a rear view.

Examples of materials for the bow portion 31, the barrel portion 32, and the stern portion 34 include stainless steel, and are not limited to specific materials. Examples of a material for the lid portion 33 include aluminium, and are not limited to a specific material.

The bow portion 31 and the lid portion 33 are fixed to the barrel portion 32 by a fastening force exerted in the cylinder axis direction of the barrel portion 32. The stern portion 34 is fixed to the lid portion 33 by a fastening force exerted in the cylinder axis direction of the barrel portion 32. More specifically, as illustrated in FIG. 8, the bow portion 31 and the lid portion 33 are fixed to the barrel portion 32 with three screws 40, and the stern portion 34 is fixed to the lid portion 33 with four screws 41.

Each of the screws 40 extends in the cylinder axis direction of the barrel portion 32. The screws 40 penetrate the bow portion 31 and extend to the fitting part 36 of the lid portion 33. An external thread is formed in a stern-side portion of each screw 40. The external thread of the screws 40 is screwed to an internal thread (not shown) formed in the fitting part 36. Screwing the screws 40 pushes the bow portion 31 against the barrel portion 32 and draws the lid portion 33 to the barrel portion 32. The screws 40 are disposed near the inner peripheral surface of the barrel portion 32. The screws 40 are arranged substantially at regular intervals in the circumferential direction of the barrel portion 32. Preferably, a waterproof treatment is performed on a portion of the bow portion 31 where the screws 40 penetrate so that entering of water into the first compartment 27 can be prevented or reduced. The waterproof treatment is not limited to a specific method, and a waterproof method using an O ring, for example, may be employed.

Each of the screws 41 extends in the cylinder axis direction of the barrel portion 32. The screws 41 penetrate the stern portion 34 and extend to the projecting part 37 of the lid portion 33. An external thread is formed on a bow-side portion of each screw 41. The external threads of the screws 41 are screwed to internal threads 42 formed in the projecting part 37. Screwing the screws 41 pushes the stern portion 34 against the lid portion 33. Two of the screws 41 penetrate an upper portion of the stern portion 34, and the other two screws 41 penetrate a lower portion of the stern portion 34 (see FIG. 5). The screws 41 are disposed not to cross the water inlet 29 in a side view. Thus, the screws 41 are less likely to affect a flow of water from the water inlet 29 to the propeller 23.

A fastening force by the screws 40 and the screws 41 exerted in the cylinder axis direction of the barrel portion 32 causes the bow portion 31 and the lid portion 33 to be fixed to the barrel portion 32, and the stern portion 34 to be fixed to the lid portion 33. Accordingly, the barrel portion 32 does not need to have through holes or the like for fastening the bow portion 31, the lid portion 33, and the stern portion 34 with screws, and a waterproof property of the first compartment 27 can be obtained with a simple configuration. Thus, productivity of the underwater propulsive device 20 can be enhanced.

The arrangements and numbers, for example, of the screws 40 and the screws 41 are not limited to those in the configuration described above, and may be designed as appropriate. Fixing of the bow portion 31 and the lid portion 33 to the barrel portion 32 and fixing of the stern portion 34 to the lid portion 33 do not necessarily use the screws 40 and the screws 41.

For example, the bow portion 31 may be fixed to the barrel portion 32 by screwing an external thread structure formed on the outer peripheral surface of a stern-side end portion of the bow portion 31 and an internal thread structure formed on the inner peripheral surface of a bow-side end portion of the barrel portion 32 together. Similarly, the lid portion 33 may be fixed to the barrel portion 32 by screwing an external thread structure formed on the outer peripheral surface of a bow-side end portion of the fitting part 36 of the lid portion 33 and an internal thread structure formed on the inner peripheral surface of a stern-side end portion of the barrel portion 32 together. In addition, the stern portion 34 may be fixed to the lid portion 33 by screwing an internal thread structure formed on the inner peripheral surface of a bow-side end portion of the stern portion 34 and an external thread structure formed on the outer peripheral surface of a stern-side end portion of the fitting part 36 of the lid portion 33 together.

With this configuration, a fastening force exerted in the cylinder axis direction of the barrel portion 32 also causes the bow portion 31 and the lid portion 33 to be fixed to the barrel portion 32 and the stern portion 34 to be fixed to the lid portion 33 so that advantages similar to those described above can be obtained. The bow portion 31 does not need to have through holes where the screws 40 penetrate, and thus, hermeticity of the first compartment 27 can be enhanced.

Figure 9:
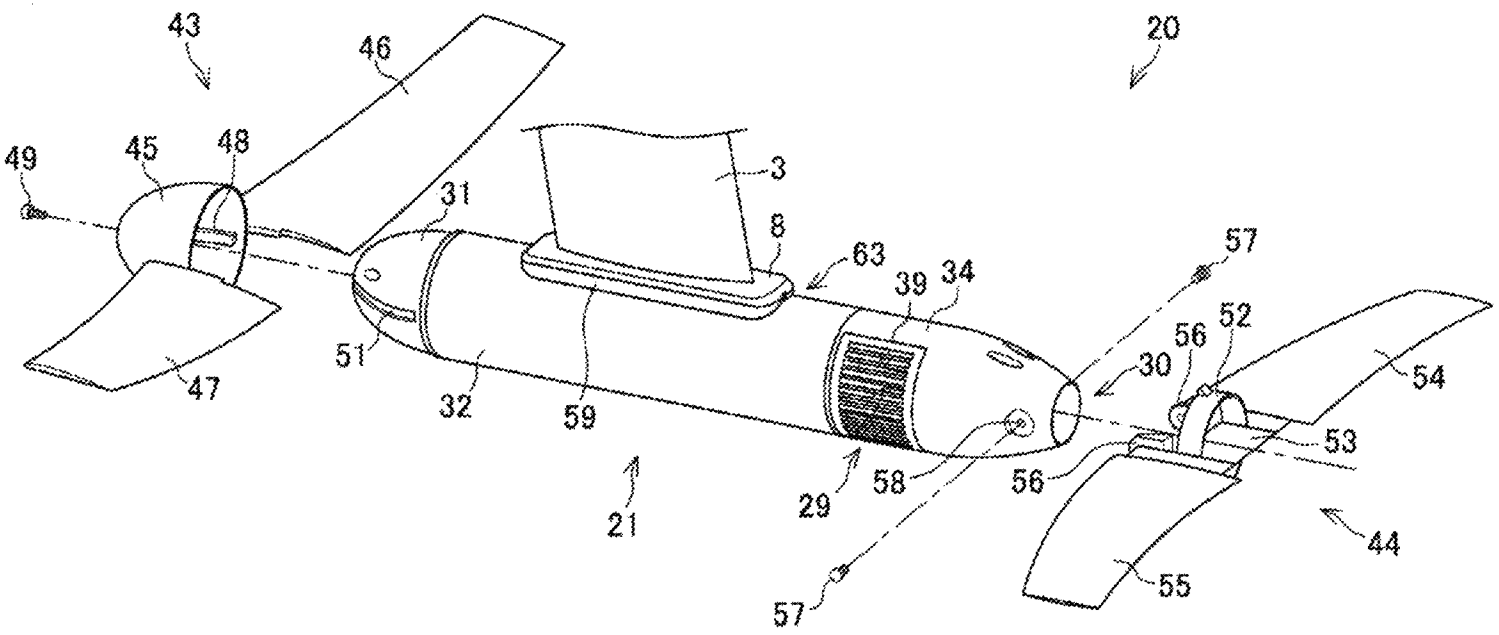
FIG. 9 A perspective view illustrating a state where a bow hydrofoil and a stern hydrofoil are attached to the body.

As illustrated in FIG. 9, the bow hydrofoil 43 and the stern hydrofoil 44 are attached to the body 21. More specifically, the bow hydrofoil 43 is detachably attached to the bow portion 31. The stern hydrofoil 44 is detachably attached to the stern portion 34. That is, the bow portion 31 is configured to be provided with the bow hydrofoil 43. The stern portion 34 is configured to be provided with the stern hydrofoil 44. FIG. 9 is a perspective view illustrating a state where the bow hydrofoil 43 and the stern hydrofoil 44 are attached to the body 21. In the state illustrated in FIG. 9, the body 21 is attached to the strut 3.

The bow hydrofoil 43 has a laterally symmetric shape. The bow hydrofoil 43 includes a dome 45, a right wing 46, and a left wing 47. The dome 45 bulges toward the bow. The right wing 46 extends rightward from the right of the dome 45. The left wing 47 extends leftward from the left of the dome 45.

The dome 45 has a shape corresponding to the bow portion 31. A rib 48 projecting inward is formed on the inner surface of the dome 45. The rib 48 extends horizontally from the right to the left of the dome 45 through the bow-side end thereof. The bow-side end of the dome 45 has an unillustrated through hole in which a screw 49 is inserted. The bow side of an end of the right wing 46 toward the dome 45 is coupled to the dome 45. Similarly, the bow side of an end of the left wing 47 toward the dome 45 is coupled to the dome 45.

As illustrated in FIG. 6, an internal thread 50 that is screwed to the screw 49 is formed in the bow-side end of the bow portion 31. A groove 51 recessed inward is formed on the outer surface of the bow portion 31. The groove 51 corresponds to the rib 48 of the dome 45. The groove 51 extends horizontally from the right to the left of the bow portion 31 across the bow-side end thereof.

Referring back to FIG. 9, the dome 45 is placed over the bow portion 31 to cover the bow side of the bow portion 31. At this time, the rib 48 is fitted in the groove 51 so that the bow hydrofoil 43 is positioned in the circumferential direction. By screwing the screw 49 to the internal thread 50 of the bow portion 31 (FIG. 6), the bow hydrofoil 43 is fixed to the bow portion 31.

The bow hydrofoil 43 is configured to generate upward lift by traveling of the watercraft 1. The shapes and sizes, for example, of the right wing 46 and the left wing 47 of the bow hydrofoil 43 are appropriately designed in accordance with the weight of the watercraft 1 and the positions of the bow hydrofoil 43 and the stern hydrofoil 44 with respect to the barycenter of the watercraft 1, for example. Examples of a material for the bow hydrofoil 43 include lightweight materials having high strength, such as fiber reinforced plastics exemplified by carbon fiber reinforced plastics, and are not limited to specific materials.

The stern hydrofoil 44 has a laterally symmetric shape. The stern hydrofoil 44 includes a ring 52, a flat plate 53, a right wing 54, a left wing 55, and attachment portions 56.

The ring 52 has a cylindrical shape extending in the cylinder axis direction of the barrel portion 32. The flat plate 53 divides the inside of the ring 52 into upper and lower parts. The flat plate 53 extends horizontally through the cylinder axis of the ring 52. The flat plate 53 is joined to the inner peripheral surface of the ring 52. The flat plate 53 has a rectangular shape in plan view. The bow-side end of the flat plate 53 is located at the bow-side end of the ring 52, and the stern-side end of the flat plate 53 is located closer to the stern than the stern-side end of the ring 52. That is, the flat plate 53 projects from the ring 52 toward the stern.

The right wing 54 extends rightward from the ring 52. The left wing 55 extends leftward from the ring 52. The end of the right wing 54 toward the ring 52 is joined to the ring 52 and the flat plate 53. Similarly, the end of the left wing 55 toward the ring 52 is joined to the ring 52 and the flat plate 53.

Each of the attachment portions 56 has a substantially rectangular shape extending in the cylinder axis direction of the barrel portion 32 in a side view. Bow-side end portions of the attachment portions 56 have unillustrated through holes in which screws 57 are inserted. The attachment portions 56 are coupled to the right wing 54 and the left wing 55. The stern-side end of the right attachment portion 56 is coupled to the right wing 54 to be swingable upward and downward. The stern-side end of the left attachment portion 56 is coupled to the left wing 55 to be swingable upward and downward.

In attaching the stern hydrofoil 44 to the stern portion 34, the ring 52 is coaxially disposed with the cylinder axis of the barrel portion 32. As illustrated in FIG. 7, internal threads 58 to be screwed to the screws 57 are formed at the left and right of a stern-side portion of the stern portion 34. By attaching the bow-side ends of the left and right attachment portions 56 to the stern portion 34 with the screws 57, the stern hydrofoil 44 is attached to the stern portion 34.

The stern hydrofoil 44 is configured to reduce tilts of the watercraft 1 in the bow direction and the stern direction during traveling in order to stabilize traveling of the watercraft 1. The shapes and sizes, for example, of the right wing 54 and the left wing 55 can be appropriately designed in accordance with the weight of the watercraft 1 and positions of the bow hydrofoil 43 and the stern hydrofoil 44 with respect to the barycenter of the watercraft 1, for example. Examples of a material for the stern hydrofoil 44 include lightweight materials having high strength, such as fiber reinforced plastics exemplified by carbon fiber reinforced plastics, and are not limited to specific materials. Members constituting the stern hydrofoil 44 may be made of different materials. For example, the ring 52 and the flat plate 53 may be made of stainless steel, and the right wing 54, the left wing 55, and the attachment portions 56 may be made of carbon fiber reinforced plastics.

As described above, the bow hydrofoil 43 is fixed to the bow portion 31 by screwing with the screw 49, and thus, can be easily attached and detached. The stern hydrofoil 44 is attached to the stern portion 34 by screwing with the screws 57, and thus, can be easily attached and detached. Thus, the underwater propulsive device 20 can be easily made in a state where the bow hydrofoil 43 and the stern hydrofoil 44 are detached therefrom so that portability of the watercraft 1 can be enhanced.

The bow hydrofoil 43 and the stern hydrofoil 44 are directly attached to the body 21. Thus, the body 21 does not need to include members for attaching the bow hydrofoil 43 and the stern hydrofoil 44.

As illustrated in FIG. 9, in the body 21, a base portion 59 formed on top of the barrel portion 32 is screwed and fastened to a flange 8 at the lower end of the strut 3. The base portion 59 has a rectangular shape extending in the cylinder axis direction of the barrel portion 32 in a plan view. The base portion 59 is fixed to an upper portion of the barrel portion 32 by, for example, welding. Examples of a material for the base portion 59 include stainless steel, and are not limited to a specific material.

Referring back to FIG. 8, an upper surface 60 of the base portion 59 is a horizontal flat surface. The upper surface 60 of the base portion 59 has a recess 61 that is depressed downward. The recess 61 is located in the lateral center of the base portion 59. The recess 61 extends from substantially the center of the base portion 59 in the propulsive direction to the stern-side end of the base portion 59. In the base portion 59, a through hole 62 is formed at a position closer to the bow than the recess 61 is. The through hole 62 communicates with the first compartment 27 through the barrel portion 32 and the base portion 59. Signal lines and power lines, etc. electrically connecting devices housed in the first compartment 27 and devices disposed on the flotation unit 2 to each other pass through the through hole 62. These signal lines and power lines pass through the strut 3 by way of the through hole 62 and are connected to the devices disposed on the flotation unit 2 from the devices housed in the first compartment 27.

The flange 8 has a rectangular shape extending in the propulsive direction in a plan view. The shape of the flange 8 corresponds to the base portion 59. The lower surface of the flange 8 is overlaid on the upper surface 60 of the base portion 59, and the four corners of the flange 8 are screwed and fastened to the base portion 59. The base portion 59 may be fixed to the flange 8 with an adhesive.

A stern-side portion of the lower surface of the flange 8 has a recess 9 that is depressed upward. The recess 9 corresponds to the recess 61 of the base portion 59. When the base portion 59 is fixed to the flange 8, the recess 9 of the flange 8 and the recess 61 of the base portion 59 form a passage 63 through which the inside and the outside of the strut 3 communicate with each other (see FIG. 5).

The through hole 62 is preferably subjected to a waterproof treatment so that water does not enter the first compartment 27 from the through hole 62. The waterproof treatment is not limited to a specific method, and a waterproof treatment by contact fitting of a rubber tube may be used. Although not shown, a cylindrical fixing tube corresponding to the through hole 62 and extending to the inside of the strut 3 is fixed to the base portion 59 by, for example, welding. The fixing tube is a tube having rigidity, and is made of aluminium, for example. The fixing tube has an outer diameter larger than the inner diameter of the rubber tube. The rubber tube extends to the flotation unit 2 through the strut 3. The fixing tube is press fitted in a lower end portion of the rubber tube. The signal lines and power lines passing through the through hole 62 are inserted in the rubber tube. This structure can prevent or reduce entering of water into the first compartment 27. The fitting parts of the rubber tube and the fixing tube may be provided with a fastening band.

Referring back to FIG. 7, an internal configuration of the body 21 will be described in detail. The motor 22 housed in the first compartment 27 of the body 21 is an AC motor, and is of an outer rotor type. The motor 22 may be a DC motor and may be of an inner rotor type, and is not limited to a specific type. The motor 22 is disposed near the lid portion 33 of the first compartment 27.

An output shaft 64 of the motor 22 is disposed on the cylinder axis of the barrel portion 32, and extends toward the lid portion 33. The bow-side end of the power transfer shaft 24 is connected to the output shaft 64 of the motor 22 through a coupling 65. The power transfer shaft 24 is disposed on the cylinder axis of the barrel portion 32. The power transfer shaft 24 extends to the vicinity of the stern-side end of the second compartment 28 through the lid portion 33. The power transfer shaft 24 is rotatably supported on the lid portion 33 by a bearing 66. A gasket 67 is disposed closer to the stern than the bearing 66 is. The gasket 67 prevents or reduces entering of water into the first compartment 27.

The propeller 23 includes a cylindrical tube 68 and three blades 69 extending radially outward from the tube 68 (see FIG. 5). The propeller 23 is disposed closer to the stern than the water inlet 29 is in the second compartment 28. The propeller 23 is fixed to the power transfer shaft 24 with the power transfer shaft 24 inserted in the tube 68. The propeller 23 is configured such that rotation of the propeller 23 causes water to be sucked in the second compartment 28 from the water inlet 29 and also water to be blown out from the water jet outlet 30. A method for fixing the propeller 23 to the power transfer shaft 24 is not limited to a specific method. The propeller 23 is fixed to the power transfer shaft 24 with, for example, screw fastening, a keyway, a spline, or pressing.

The outer diameter of the tube 68 is substantially equal to the outer diameter of the stern-side end of the projecting part 37 of the lid portion 33. A cylindrical spacer 70 inserted in the power transfer shaft 24 is disposed between the projecting part 37 and the tube 68. The outer diameter of the spacer 70 is substantially equal to the outer diameter of the tube 68. The outer peripheral surface of the projecting part 37, the outer peripheral surface of the spacer 70, and the outer peripheral surface of the tube 68 are smoothly connected to one another. This configuration can suppress generation of disturbance in a water flow from the water inlet 29 to the propeller 23.

The inner diameter of the stern portion 34 gradually decreases from the stern-side end of the water inlet 29 toward the stern, and is substantially equal to the outer diameter of the propeller 23 at a position where the propeller 23 is located. The inner diameter of the stern portion 34 gradually decreases toward the stern in a stern-side end portion of the stern portion 34. That is, the cross-sectional area of a channel of water flowing from the water inlet 29 to the water jet outlet 30 gradually decreases from the water inlet 29 toward the propeller 23, becomes uniform at the position of the propeller 23, and then further decreases near the water jet outlet 30. Thus, a flow velocity of water flowing from the water inlet 29 to the water jet outlet 30 by rotation of the propeller 23 increases with a decrease in cross-sectional area of the channel, and is at maximum near the water jet outlet 30.

The outer peripheral surface of the projecting part 37 of the lid portion 33 is curved to be depressed inward. This configuration can suppress generation of disturbance in a water flow from the water inlet 29 to the propeller 23. The outer peripheral surface of the projecting part 37, however, is not limited to such a shape. For example, the outer peripheral surface of the projecting part 37 may be curved to bulge outward.

The stern-side end of the power transfer shaft 24 is rotatably supported by a support portion 71. The support portion 71 includes a cylindrical tube 72 and three straightening vanes 73 (see FIG. 5). The straightening vanes 73 extend radially outward from the tube 72 and are joined to the inner peripheral surface of the stern portion 34. The straightening vanes 73 are twisted in the direction opposite to the direction of the blades 69 of the propeller 23.

The stern-side end of the power transfer shaft 24 is inserted in the tube 72, and is rotatably supported on the support portion 71 by a bearing (not shown). That is, the bow-side end and the stern-side end of the power transfer shaft 24 are both rotatably supported so that rotation runout can be reduced. Water blown out from the water jet outlet 30 by rotation of the propeller 23 is in a state where rotation about the power transfer shaft 24 is cancelled by the straightening vanes 73. Thus, the underwater propulsive device 20 can generate an effective propulsive force.

The power transfer shaft 24 only needs to extend in the propulsive direction and connect the motor 22 and the propeller 23 to each other, and is not limited to the configuration described above. For example, the power transfer shaft 24 may be configured such that the stern-side end is not supported by the support portion 71 and only one end is rotatably supported by the lid portion 33. The numbers and shapes of the blades 69 of the propeller 23 and the straightening vanes 73 are not specifically limited, and may be appropriately designed.

The outer diameter of the propeller 23 is smaller than the maximum diameter of the first compartment 27. That is, the outer diameter of the propeller 23 is smaller than the outer diameter of the barrel portion 32. Preferably, the outer diameter of the propeller 23 is smaller than the inner diameter of the barrel portion 32. This configuration can prevent or reduce an excessive increase in the size of the propeller 23 relative to the motor 22 housed in the first compartment 27. Thus, an excessive load is not applied to the motor 22 so that a failure and a decrease in lifetime of the motor 22 can be prevented or reduced. The underwater propulsive device 20 can also be continuously driven for a long period, and can be used easily. In the underwater propulsive device 20, the motor 22 can be a small-size motor rotatable at high speed with a low torque without using a speed reducer. Consequently, the underwater propulsive device 20 can be made compact and lightweight and have reduced drag without a decrease in propulsive output.

In general, if the outer diameter of a propeller is large, a motor capable of outputting a high torque is needed. However, since the motor capable of outputting a high torque has a large diameter, of course, in the case of disposing the motor under the water, a contradiction to the demand for reducing the diameter of the motor occurs. On the other hand, to increase a torque in a motor that has a small diameter, that is, rotates at high speed, it is necessary to dispose a speed reducer between the motor and a propeller, but the presence of the speed reducer complicates a mechanism of the underwater propulsive device, and is not preferable in terms of costs. On the other hand, in the underwater propulsive device 20 according to this embodiment, since the outer diameter of the propeller 23 is smaller than the diameter of the first compartment 27, a motor that has a small diameter and rotates at high speed can be used without using a speed reducer. The propeller 23 can be completely housed in the body 21.

The cross-sectional areas of the water inlet 29 and the water jet outlet 30 can be appropriately designed in accordance with performances of the propeller 23 and the motor 22. The water inlet 29 only needs to be located closer to the bow than the propeller 23 is and formed in the circumferential direction of the power transfer shaft 24, and the shape and the position in the circumferential direction are not specifically limited. For example, the water inlet 29 may be formed in the entire circumference of the power transfer shaft 24.

Figure 10:
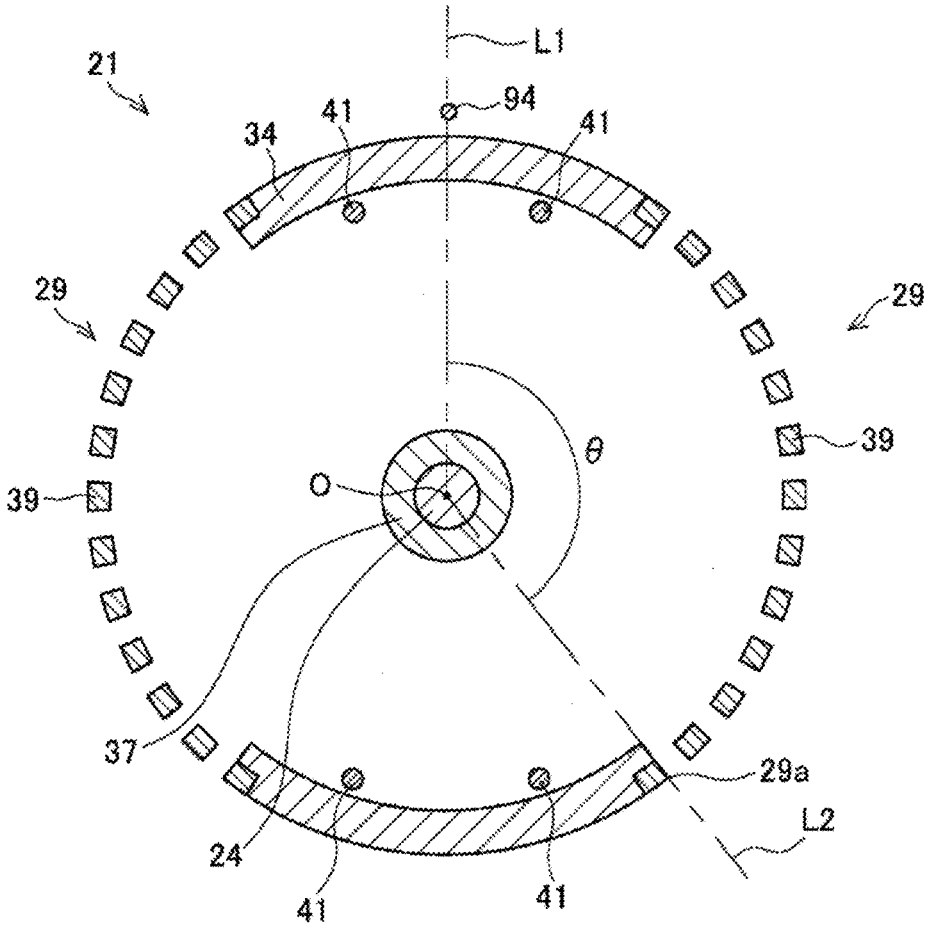
FIG. 10 A cross-sectional view taken along line X-X in FIG. 3.

In a general personal watercraft, for example, a water inlet is formed at the bottom (at the bottom of the watercraft). However, the body 21 of the underwater propulsive device 20 according to this embodiment is a hollow propulsive body completely sunk under the water, and the water inlet 29 is preferably not open downward. A preferable configuration of the water inlet 29 will now be described with reference to FIG. 10. FIG. 10 is a vertical cross-sectional view of the underwater propulsive device 20, more specifically, a cross-sectional view taken along line X-X in FIG. 3.

In FIG. 10, L1 is a straight line extending vertically upward through a shaft center O of the power transfer shaft 24. In addition, L2 is a straight line passing through the shaft center O of the power transfer shaft 24 and a lower end 29*a* of the water inlet 29. The water inlet 29 is preferably configured such that an angle θ formed by the straight line L1 and the straight line L2 is 90° or more and 160° or less. With such a configuration, a sufficient area of the water inlet 29 is obtained, and when the underwater propulsive device 20 approaches the bottom of water (e.g., sea bottom, lake bottom, or river bottom), foreign matter such as pebbles at the bottom of water is less likely to be sucked in the first compartment 27, and damage caused by sucking of foreign matter in the underwater propulsive device 20 can be prevented or reduced.

As described above, the water inlet 29 is covered with the filter 39. Thus, entering of foreign matter such as algae and refuse in the second compartment 28 can be prevented or reduced. Accordingly, in the underwater propulsive device 20, damage caused by sucking of foreign matter can be prevented or reduced, and durability can be enhanced.

The filter 39 only needs to be configured to enable prevention or reduction of entering of foreign matter in the second compartment 28, and the number and the width, for example, of slits can be appropriately designed. The filter 39 may be configured such that slits extend circumferentially, for example, or may be a wire net formed by twisting metal wires, or may be a combination of slits and wire nets. However, the filter 39 is preferably configured to include a plurality of slits extending in the propulsive direction, as described in this embodiment. In this configuration, foreign matter is less likely to be caught by the filter 39, and the water inlet 29 is less likely to be clogged by foreign matter. Thus, a decrease in a propulsive force of the underwater propulsive device 20 can be prevented or reduced.

Figure 11:
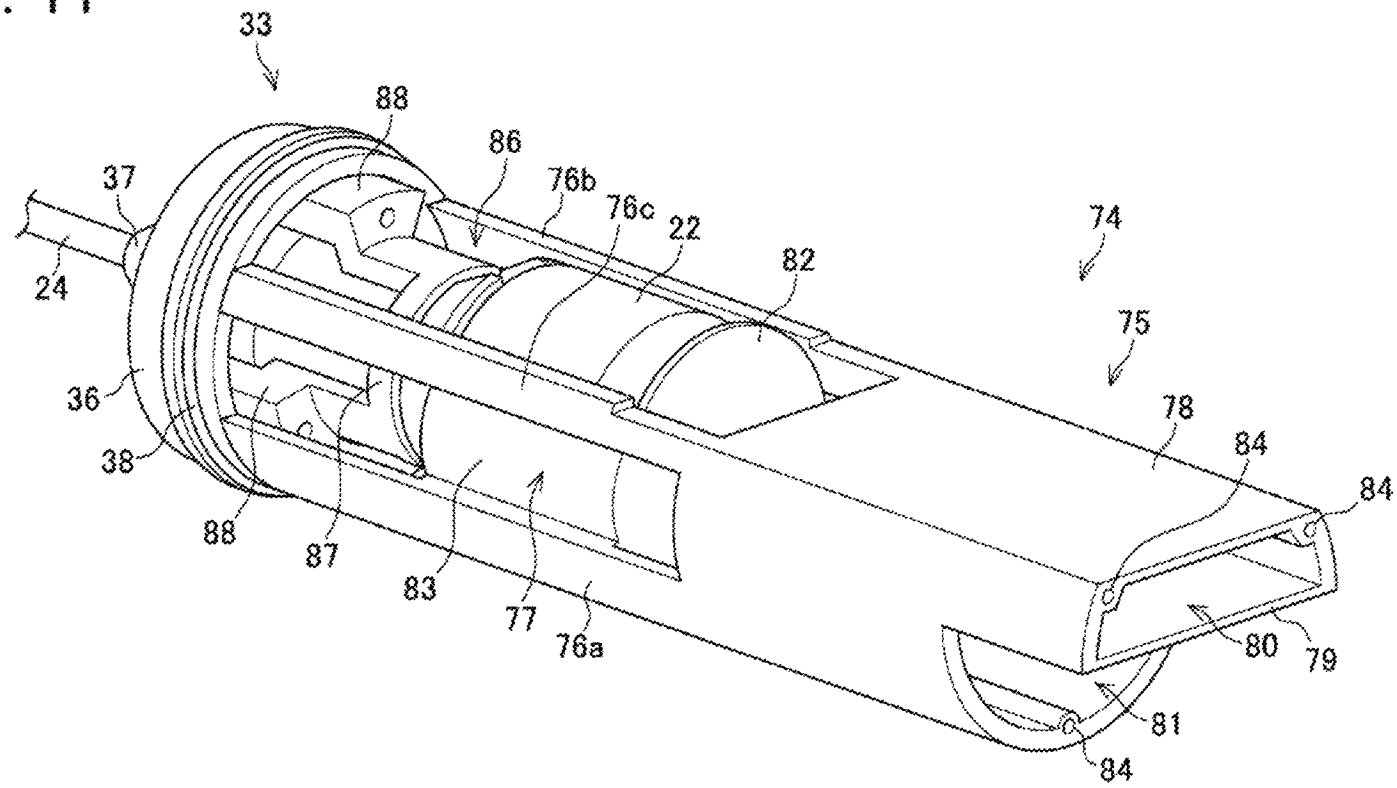
FIG. 11 A perspective view illustrating an example of an inner case of the underwater propulsive device.

The waterproof first compartment 27 houses the motor 22, the inverter 25, the control unit 26, and so forth, as described above. The inverter 25 and the control unit 26, for example, are housed in the barrel portion 32 while being supported by an inner case 74 illustrated in FIG. 11. FIG. 11 is a perspective view illustrating an example of the inner case 74, and a perspective view of the inner case 74 when seen obliquely from above at the bow side. In FIG. 11, the motor 22, the lid portion 33, and inner case 74 are illustrated in a positional relationship housed in the unillustrated barrel portion 32. In FIG. 11, the right is the bow side, and the left is the stern side.

As illustrated in FIG. 11, the inner case 74 includes a cylindrical housing portion 75 extending in the cylinder axis direction of the barrel portion 32, three leg portions 76*a*, 76*b*, and 76*c* extending from the housing portion 75 toward the stern, and a protection portion 77 surrounding the motor 22.

The housing portion 75 has a horizontal flat surface 78 in an upper portion thereof. A lower portion of the housing portion 75 has an arch shape. The inner diameter of the housing portion 75 is larger than the outer diameter of the motor 22. The inside of the housing portion 75 is partitioned into an upper room 80 and a lower room 81 by a partition plate 79. The inverter 25 is housed in the lower room 81. The control unit 26 is housed in the upper room 80. The inverter 25 and the control unit 26 are fixed to the inner case 74.

The lower leg portion 76*a* extends from the stern-side end of the housing portion 75 in the stern direction to cover the bottom of the motor 22. The leg portion 76*a* is formed by extending a lower portion of the arc-shaped housing portion 75. The upper leg portions 76*b* and 76*c* extend from the stern-side end of the housing portion 75 in the stern direction. The leg portions 76*b* and 76*c* are formed by extending the left and right corners of an upper portion of the housing portion 75. The stern-side ends of the leg portions 76*a*, 76*b*, and 76*c* are in contact with the bow-side end of the fitting part 36 of the lid portion 33.

The protection portion 77 is constituted by a circular protection plate 82 disposed at the bow side of the motor 22 and two protection plates 83 disposed at the left and right sides of the motor 22, for example. The outer diameter of the protection plate 82 is larger than the outer diameter of the motor 22. A lower portion of the protection plate 82 is joined to the leg portion 76*a*. The protection plates 83 are curved in arc shapes along the outer peripheral surface of the motor 22. Upper portions of the protection plates 83 are joined to the leg portions 76*b* and 76*c*. The blow-side ends of the protection plates 83 are joined to the protection plate 82. The protection portion 77 covers the left and right of the motor 22 and the bow side of the motor 22.

In the inner case 74, space separated from the motor 22 is formed by the protection portion 77 at the left and right of the motor 22 and the bow side of the motor 22 (see FIG. 7). Unillustrated power lines and signal lines and a cooling water passage described later, for example, are routed in this space and in a space between the flat surface 78 of the housing portion 75 and the inner peripheral surface of the barrel portion 32, for example. The power lines, the signal lines, and the cooling water passage, for example, are separated from the motor 22 by the protection portion 77 so as not to contact the motor 22.

Examples of a material for the inner case 74 include a lightweight material capable of being processed easily, such as plastics (ABS resin), and are not limited to specific materials. The inner case 74 has three attachment holes 84 extending in parallel with the cylinder axis of the barrel portion 32 and penetrating the housing portion 75 and the leg portions 76*a*, 76*b*, and 76*c*. Internal threads unillustrated here and corresponding to the attachment holes 84 are formed in the fitting part 36 of the lid portion 33. The screws 40 for fixing the bow portion 31 and the lid portion 33 to the barrel portion 32 described above are inserted in the attachment holes 84 and screwed to the internal threads of the fitting part 36.

The inverter 25 includes a switching element, for example, and is configured to convert DC power supplied from the battery to AC power having a desired frequency. The rotation speed of the motor 22 is changed by changing the frequency of AC power supplied to the motor 22. The inverter 25 is housed in the barrel portion 32 while being housed in the inner case 74, and is disposed adjacent to the bow side of the motor 22. The inverter 25 is not limited to a specific configuration. The motor driving circuit is not limited to the inverter 25, and may be appropriately designed in accordance with the configuration of the motor 22. For example, in the case where the motor 22 is a DC motor, the motor driving circuit is configured to supply DC power supplied from the battery to the motor 22 at a desired voltage. The rotation speed of the motor 22 is changed by changing the voltage of DC power supplied to the motor 22.

The control unit 26 is configured to control the motor 22 by controlling the inverter 25. The control unit 26 is electrically connected to the inverter 25. Although not shown, the control unit 26 is connected to the battery through a converter incorporated in the flotation unit 2 so that DC power at a predetermined voltage is supplied from the battery. The control unit 26 is also electrically connected to a control unit incorporated in the flotation unit 2, which will be described specifically later.

Examples of the control unit 26 include a control board including a central processing unit (CPU) that performs a computation process and a control process, a main memory device that stores data, a timer, an input circuit, an output circuit, and so forth. The main memory device exemplified by a read only memory (ROM) and an electrically erasable programmable read only memory (EEPROM) stores a control program and various types of data. The control unit 26 is housed in the barrel portion 32 while being housed in the inner case 74. The control unit 26 is not limited to a specific configuration, and may be constituted by a plurality of control boards, for example.

The inverter 25 and the control unit 26 can be housed in the barrel portion 32 together with the inner case 74. Thus, the inverter 25 and the control unit 26 can be easily housed in the barrel portion 32 so that productivity of the underwater propulsive device 20 can be enhanced.

The inverter 25 is disposed close to the bow than the motor 22 is in the propulsive direction. That is, the motor 22, the inverter 25, and the propeller 23 are arranged side by side in the propulsive direction. Accordingly, dimensions of the body 21 in the radial direction (top-bottom directions and left-right directions) can be reduced so that a propulsive resistance of the underwater propulsive device 20 can be reduced.

More specifically, the inverter 25 is located closer to the bow than the motor 22 is, and adjacent to the motor 22. Thus, a power line between the motor 22 and the inverter 25 can be shortened so that the underwater propulsive device 20 can be made compact. The reduction of the length of the power line can reduce the amount of heat generated by the power line, a voltage drop in the power line, and electromagnetic noise generated by the power line, for example.

In addition, since the distance between the motor 22 and the inverter 25 is small, not an electric wire coated with an insulator but a bus bar can be used as the power line between the motor 22 and the inverter 25. The cross-sectional area of the bus bar is smaller than the cross-sectional area of the electric wire. Thus, in the case of using a bus bar as a power line, the diameter of the body 21 can be reduced so that the underwater propulsive device 20 can be made compact.

In a case where the motor 22 is a three-phase AC motor, three power lines are provided between the motor 22 and the inverter 25, and thus, a large space is needed to route the power lines. However, since the inverter 25 is disposed adjacent to the motor 22, a space necessary for routing power lines can be downsized so that the underwater propulsive device 20 can be made compact even in the case where the motor 22 is a three-phase AC motor.

The watercraft 1 is configured such that the flotation unit 2 does not incorporate the inverter 25 and the underwater propulsive device 20 incorporates the inverter 25. Thus, in the watercraft 1, it is unnecessary to route three power lines in the strut 3 even in the case where the motor 22 is a three-phase AC motor, the strut 3 can be made thin, and the watercraft 1 can travel with a reduced water resistance.

The inner case 74 is not limited to the configuration described above as long as the inner case 74 can house the inverter 25 and the control unit 26. For example, the inner case 74 may be configured such that the inside of the housing portion 75 is divided into left and right parts by the partition plate 79.

As illustrated in FIG. 11, the motor 22 is fixed to the fitting part 36 of the lid portion 33 through a coupling member 86. The coupling member 86 includes, for example, an annular joint portion 87 and three leg portions 88 extending from the joint portion 87 toward the stern. The leg portions 88 are arranged at substantially regular intervals in the circumferential direction. The output shaft 64 of the motor 22 is inserted in the joint portion 87 (see FIG. 7), and the stern-side end of the motor 22 is fixed to the joint portion 87.

The leg portions 88 of the coupling member 86 are fixed to the fitting part 36 of the lid portion 33. That is, the motor 22 is not supported by the barrel portion 32 but is supported, at one side, by the lid portion 33 with the coupling member 86 interposed therebetween. This configuration can eliminate or reduce the necessity for forming through holes or the like for screwing and fastening the motor 22 to the barrel portion 32, and thus, hermeticity of the first compartment 27 can be enhanced. The barrel portion 32 does not need to have a complicated configuration in which a base or the like for supporting the motor 22 is provided inside. The lid portion 33 to which the motor 22 is fixed is inserted in the barrel portion 32 so that the motor 22 is disposed inside the barrel portion 32. Accordingly, the motor 22 can be easily disposed inside the barrel portion 32 so that productivity of the underwater propulsive device 20 can be enhanced.

Since the motor 22 is capable of being fixed to the lid portion 33, a driving mechanism section is completed before assembly of the underwater propulsive device 20. Thus, it is possible to suppress degradation of accuracy and stiffness in attaching the driving mechanism section.

Figure 12:
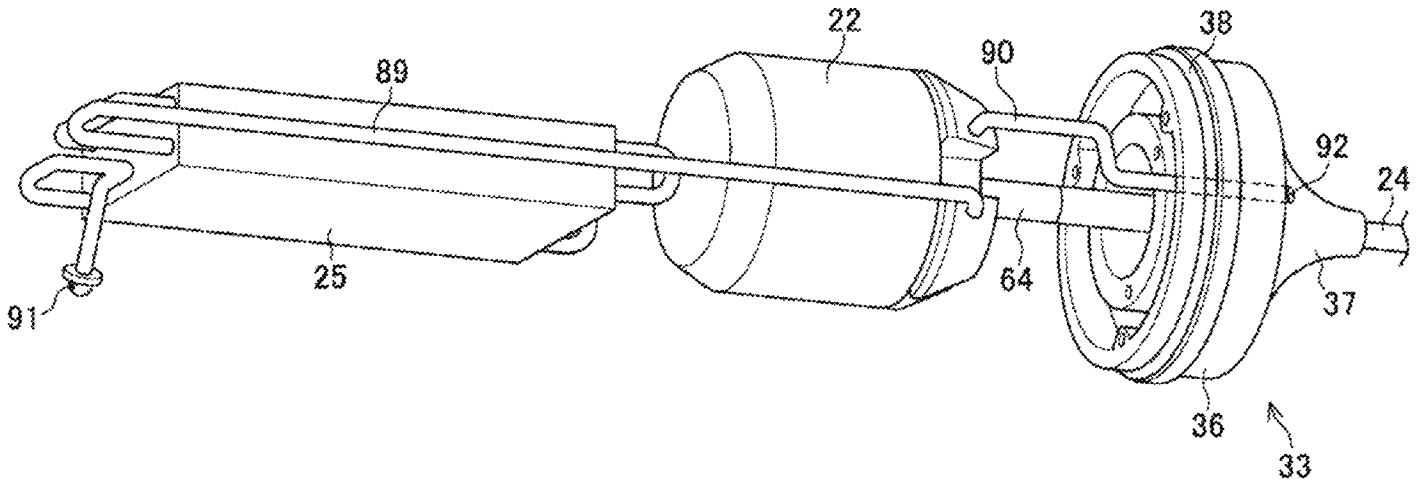
FIG. 12 A perspective view illustrating an example of a cooling water passage of the underwater propulsive device.

As illustrated in FIG. 12, the underwater propulsive device 20 further includes pipes 89 and 90. The pipes 89 and 90 are cooling water passages passing through the first compartment 27. FIG. 12 is a perspective view illustrating an example of the pipes 89 and 90, and is a perspective view of the pipes 89 and 90 when seen from obliquely below the bow side. FIG. 12 also illustrates the motor 22, the inverter 25, and the lid portion 33. In the illustration, the motor 22, the inverter 25, and the lid portion 33 have a positional relationship in a case where these components are housed in the unillustrated barrel portion 32. In FIG. 12, the right is the stern side, and the left is the bow side.

A suction port 91 is formed at one end of the pipe 89. The pipe 89 passes through the inverter 25 while extending to and fro along the propulsive direction. The other end of the pipe 89 is connected to one end of the cooling water passage (not shown) of the motor 22. One end of the pipe 90 is connected to the other end of the cooling water passage of the motor 22. The other end of the pipe 90 has a discharge port 92.

Preferably, a portion of the barrel portion 32 where the pipe 89 penetrates and a portion of the lid portion 33 where the pipe 90 penetrates are subjected to a waterproof treatment so that entering of water into the first compartment 27 can be prevented or reduced. The method for the waterproof treatment is not limited to a specific method, and examples of the method includes a waterproof treatment using an O ring and a waterproof treatment of filling gaps with an epoxy resin or a silicone resin.

Water is caused to flow in the pipes 89 and 90. Water flowing in the pipes 89 and 90 cools the motor 22 and the inverter 25. Water is taken into the pipe 89 from the suction port 91. This water flows in the pipe 89 passing through the inverter 25, the cooling water passage of the motor 22, and the pipe 90 in this order, and is discharged from the discharge port 92 at the other end of the pipe 90.

The pipes 89 and 90 may be made of stainless steel, for example, but materials for the pipes 89 and 90 are not limited to specific materials. The pipes 89 and 90 may be partially made of a flexible rubber tube, for example, in terms of assembly.

As illustrated in FIGS. 4 and 5, the suction port 91 of the pipe 89 projects radially outward from the barrel portion 32. As illustrated in FIG. 7, the pipe 90 penetrates the lid portion 33 in the propulsive direction and communicates with the second compartment 28.

As illustrated in FIG. 7, the discharge port 92 communicates with the water inlet 29. More specifically, the discharge port 92 is disposed in a portion of a channel for water flowing from the water inlet 29 to the water jet outlet 30 by rotation of the propeller 23, the portion being located upstream of the propeller 23. In this portion, the pressure significantly decreases by rotation of the propeller 23 as compared to the outside of the body 21 where the suction port 91 (FIGS. 4 and 5) is located. Water is sucked from the suction port 91 to the pipe 89 by a pressure difference between the suction port 91 and the discharge port 92, and is discharged from the discharge port 92 through the pipe 90. Thus, the underwater propulsive device 20 can cool the motor 22 and the inverter 25 with a simple configuration without using an actuator for causing water to flow in the pipes 89 and 90, such as a pump.

The suction port 91 is open to the traveling direction. Preferably, the suction port 91 is located substantially vertically to the traveling direction. Thus, when the watercraft 1 travels, water is thereby sucked to be pushed into the suction port 91. Accordingly, the underwater propulsive device 20 can increase the flow rate of water flowing in the pipes 89 and 90 without using an actuator for causing water to flow in the pipes 89 and 90, for example, so that the cooling efficiency of the motor 22 and the inverter 25 can be increased with a simple configuration.

The position and orientation of the suction port 91 are not specifically limited. For example, the end of the pipe 89 where the suction port 91 is formed may project outward from the bow portion 31. The suction port 91 may tilt relative to the traveling direction outside the body 21.

For example, the suction port 91 may be disposed in the second compartment 28 and near the outer periphery of the propeller 23. In a portion near the outer periphery of the propeller 23, the pressure is significantly increased by rotation of the propeller 23 to be higher than that in a portion of water channel of the second compartment 28 where the discharge port 92 is located and upstream of the propeller 23. This pressure difference can push water into the pipe 89 through the suction port 91. Even with this configuration, the underwater propulsive device 20 can increase the flow rate of water flowing in the pipes 89 and 90 without using, for example, an actuator for causing water to flow in the pipes 89 and 90 so that cooling efficiency of the motor 22 and the inverter 25 can be enhanced with a simple configuration.

The cooling water passage for cooling the motor 22 and the inverter 25 are not limited to the configuration of the pipes 89 and 90 described above. The cooling water passage only needs to be configured to have the suction port 91 and the discharge port 92 and pass through the first compartment 27. For example, the cooling water passage may be configured to cool the inverter 25 after cooling the motor 22. The cooling water passage may also be configured to cool the control unit 26 together with the motor 22 and the inverter 25.

Referring back to FIG. 3, a swing operation of the stern hydrofoil 44 will be described. As described above, the stern hydrofoil 44 is attached to the stern portion 34 to be swingable upward and downward. A linkage mechanism 93 is connected to the stern hydrofoil 44. The stern hydrofoil 44 is coupled to and interlocked with the water surface sensor 4 by the linkage mechanism 93.

The linkage mechanism 93 includes wires 94 and 95 and a coupling arm 96. One end of the wire 94 is coupled to the stern hydrofoil 44. One end of the wire 95 is coupled to the water surface sensor 4 (FIG. 1). The coupling arm 96 connects the wire 94 and the wire 95 to each other.

One end of the wire 94 is coupled to the upper end of the ring 52 of the stern hydrofoil 44. The wire 94 extends in the traveling direction along an upper portion of the barrel portion 32. The wire 94 extends to the inside of the strut 3 through the passage 63 (FIG. 5) formed between the base portion 59 of the barrel portion 32 and the flange 8 of the strut 3. The wire 95 and the coupling arm 96 are housed in the strut 3. One end of the wire 95 is coupled to a crank (not shown) formed on the pivoting shaft of the bar 5 (FIG. 1) of the water surface sensor 4. The coupling arm 96 has a substantially inverted L shape in a side view. The coupling arm 96 is supported on the strut 3 to be swingable upward and downward using a bent portion as a fulcrum. The other end of the wire 94 is coupled to the lower end of the coupling arm 96. The other end of the wire 95 is coupled to the upper end of the coupling arm 96.

The stern hydrofoil 44 is coupled to and interlocked with the water surface sensor 4 by the linkage mechanism 93 having the configuration as described above. The stern hydrofoil 44 is caused to swing upward and downward in accordance with a pivot operation of the water surface sensor 4 about the strut 3. As illustrated in FIG. 1, in traveling of the watercraft 1, in a case where the distance from the flotation unit 2 to the water surface 7 is a predetermined distance, the stern hydrofoil 44 is in a steady state in which the right wing 54 and the left wing 55 extend horizontally.

Figure 13:
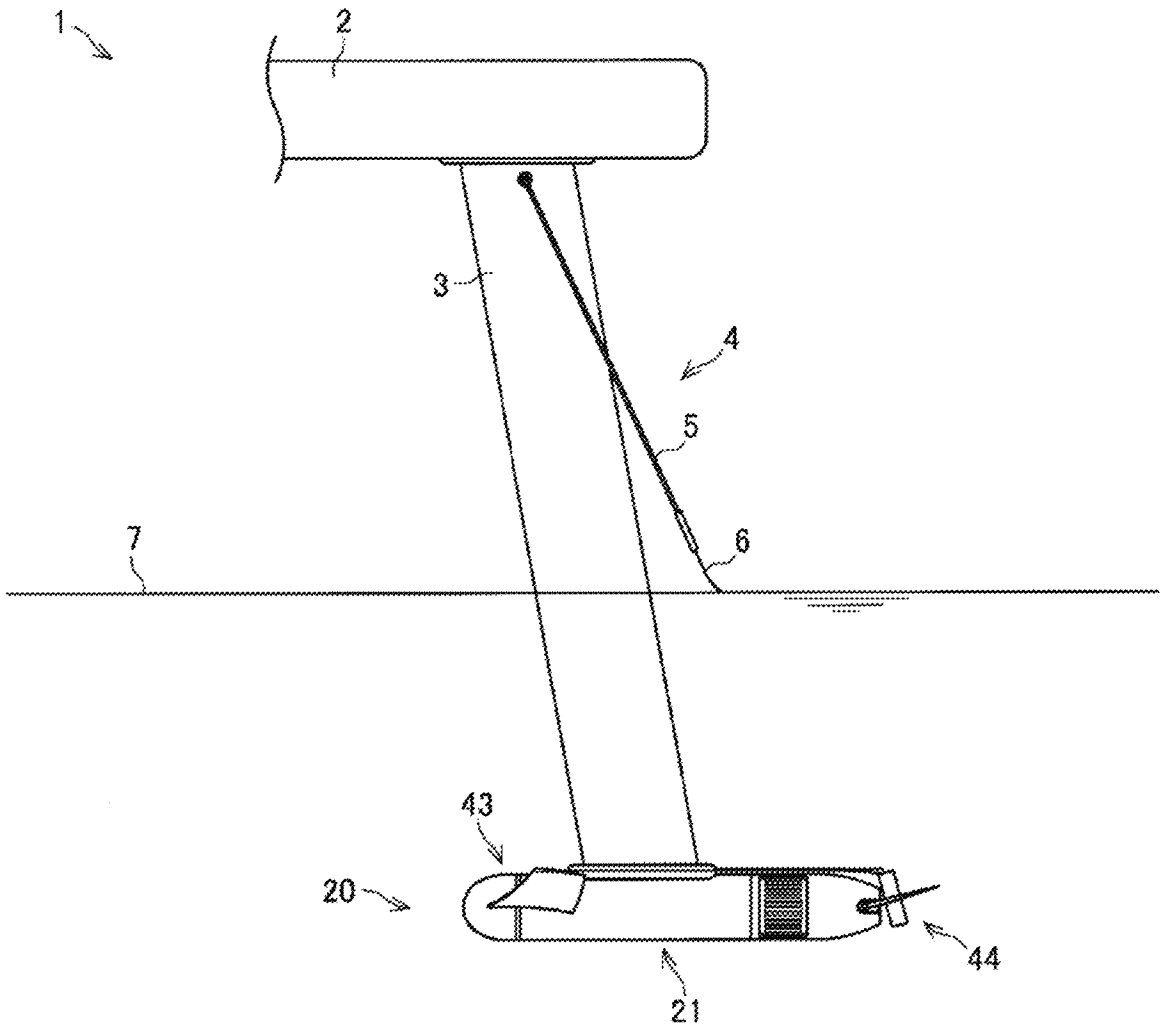
FIG. 13 A side view illustrating an example of a traveling state of the watercraft.

FIG. 13 is a side view illustrating an example of the traveling state of the watercraft 1. As illustrated in FIG. 13, from the state of FIG. 1 that is the steady state, when the distance between the flotation unit 2 and the water surface 7 becomes larger than the predetermined distance, the water surface sensor 4 pivots downward by its own weight. On the other hand, although not described with reference to the drawings, when the distance between the flotation unit 2 and the water surface 7 becomes smaller than the predetermined distance from the state of FIG. 1 that is the steady state, the water surface sensor 4 pivots upward. In accordance with the pivot of the water surface sensor 4, the stern hydrofoil 44 swings with respect to the strut 3 such that the distance between the flotation unit 2 and the water surface 7 is kept at the predetermined distance.

Figure 14:
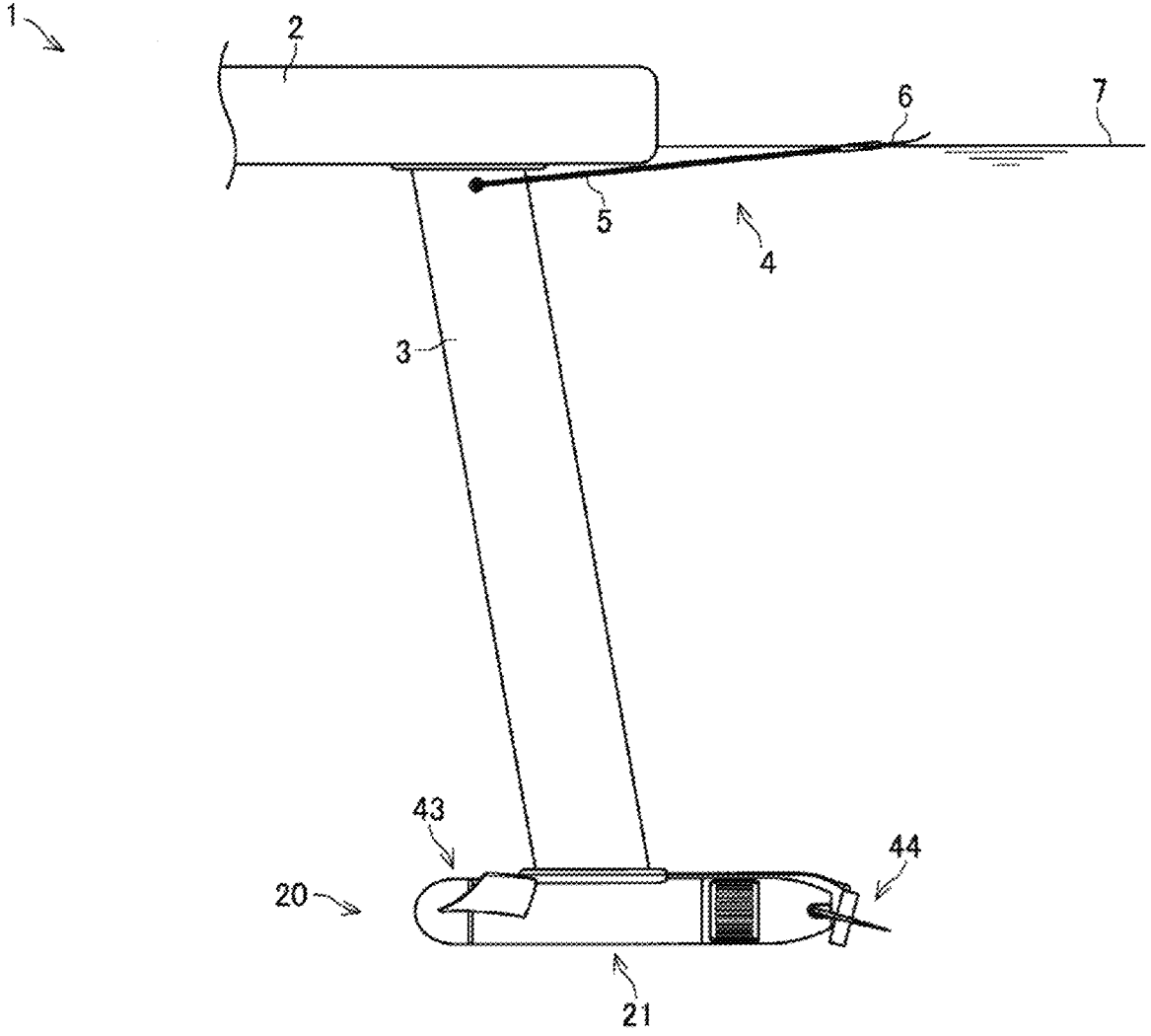
FIG. 14 A side view illustrating an example of a stationary state of the watercraft.

FIG. 14 is a side view illustrating an example of a stationary state of the watercraft 1. While the watercraft 1 is in the stationary state, the water surface sensor 4 is pivoted upward by buoyancy, as illustrated in FIG. 14.

The linkage mechanism 93 only needs to be configured to couple and interlock the water surface sensor 4 and the stern hydrofoil 44 with each other, and is not limited to the configuration described above. The linkage mechanism 93 may be disposed outside the strut 3. However, from the viewpoint of drag reduction and protection for example, the linkage mechanism 93 is preferably disposed inside the strut 3.

Figure 15:
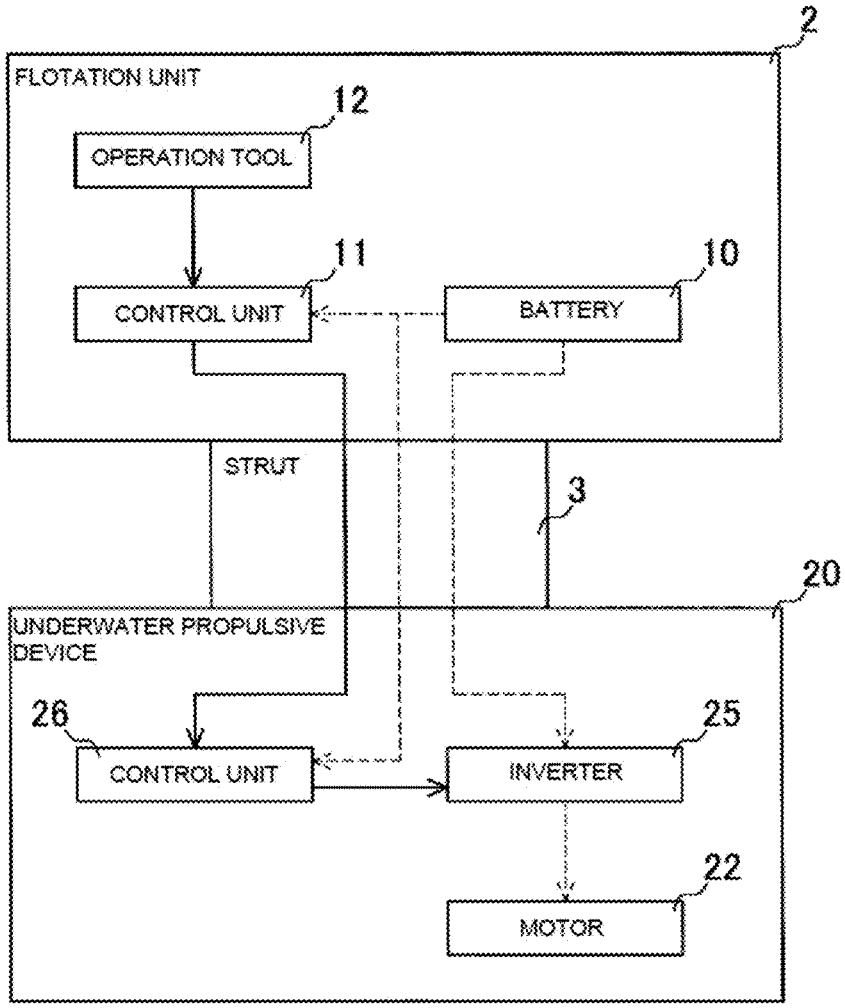
FIG. 15 A block diagram illustrating a main section of a control system of the watercraft.

Next, a control system of the watercraft 1 will be specifically described. FIG. 15 is a block diagram illustrating a main portion of the control system of the watercraft 1. In FIG. 15, supply of electric power is illustrated by broken lines. The watercraft 1 further includes a battery 10 incorporated in the flotation unit 2, a control unit 11, and an operation tool 12 that is attached to the flotation unit 2.

The control unit 11 is electrically connected to the control unit 26 of the underwater propulsive device 20 and the operation tool 12. The control unit 11 is connected to the battery 10 through an unillustrated converter incorporated in the flotation unit 2, and is supplied with DC power at a predetermined voltage from the battery 10. The control unit 11 is configured to read various setting values and an input signal from the operation tool 12 and output a control signal to the control unit 26 of the underwater propulsive device 20 based on the input signal.

In a manner similar to the control unit 26 of the underwater propulsive device 20, examples of the control unit 11 include a control board including a central processing unit (CPU) that performs a computation process and a control process, a main memory device that stores data, a timer, an input circuit, an output circuit, and so forth. The main memory device exemplified by a read only memory (ROM) and an electrically erasable programmable read only memory (EEPROM) stores a control program and various types of data. The control unit 11 is not limited to a specific configuration, and may be constituted by a plurality of control boards, for example.

Based on an input signal from the operation tool 12, the control unit 11 outputs a control signal to the control unit 26 of the underwater propulsive device 20, and based on this control signal, the control unit 26 of the underwater propulsive device 20 outputs a control signal to the inverter 25. The inverter 25 changes the frequency of AC power to be supplied to the motor 22 based on the received control signal so that the rotation speed of the motor 22 can be changed, and the traveling speed of the watercraft 1 is changed.

The control unit 11 of the flotation unit 2 and the control unit 26 of the underwater propulsive device 20 may be configured to communicate with each other. Communication between the control unit 11 and the control unit 26 may be serial communication or parallel communication. However, from the viewpoint of drag reduction, the communication between the control unit 11 and the control unit 26 is preferably serial communication. The serial communication can enable one communication line to connect the control unit 11 and the control unit 26 to each other. Accordingly, the number of communication lines passing through the strut 3 is reduced so that the strut 3 can be made thin. Consequently, the watercraft 1 can be traveled with reduced drag.

The underwater propulsive device 20 is not limited to the configuration described above. For example, the underwater propulsive device 20 may not include the control unit 26. In such a configuration, the underwater propulsive device 20 is configured such that a control signal is output from the control unit 11 incorporated in the flotation unit 2 to the inverter 25.

The underwater propulsive device 20 may be configured to include, for example, a pressure sensor for measuring a traveling speed of the watercraft 1, a temperature sensor for measuring temperatures of the motor 22 and the inverter 25, and an acceleration sensor for measuring a tilt and other parameters of the watercraft 1. These sensors are electrically connected to the control unit 26. In this case, the control unit 26 is configured to calculate the traveling speed of the watercraft 1 based on a detection value of the pressure sensor, calculate temperatures of the motor 22 and the inverter 25 based on a detection value of the temperature sensor, or calculate a tilt and other parameters of the watercraft 1 based on a detection value of the acceleration sensor.

In a case where the underwater propulsive device 20 includes the various sensors, a display device that is controlled by the control unit 11 is preferably disposed in the flotation unit 2. The display device displays the velocity, the temperature, the tilt, and other parameters calculated by the control unit 26. The display device may display the amount of electric power of the battery 10, a travelable distance, and so forth. The display device is not specifically limited, and a waterproof liquid crystal monitor, for example, may be used. Such a configuration enables a user to know the traveling state of the watercraft 1 so that the watercraft 1 can be used easily.

The control unit 26 may also be configured to control the motor 22 based on detection values of the sensors. For example, the motor 22 may be controlled, for example, such that the velocity of the watercraft 1 does not increase to a predetermined velocity or higher. In addition, the underwater propulsive device 20 may also be configured to include a driving mechanism that causes the stern hydrofoil 44 to swing actively and that is controlled by the control unit 26 based on detection results of the sensors. Such a configuration enables control of the posture of the watercraft 1.

Instead of the control unit 26, the control unit 11 may calculate the values described above. The acceleration sensor may be disposed in the flotation unit 2. A receiver that receives radio waves from a positioning satellite may be disposed in the flotation unit 2 so that a traveling speed can be calculated using a global navigation satellite system (GNSS).

The bow hydrofoil 43 of the underwater propulsive device 20 may be attached to the barrel portion 32 or the stern portion 34, for example. The underwater propulsive device 20 may not include the bow hydrofoil 43. The bow hydrofoil 43 may be included in, for example, the strut 3.

The underwater propulsive device 20 may be configured such that the stern hydrofoil 44 is fixed to the body 21. The stern hydrofoil 44 may be disposed at a position except for the vicinity of the water jet outlet 30. The underwater propulsive device 20 may not include the stern hydrofoil 44. The stern hydrofoil 44 may be included in, for example, the strut 3.

The body 21 of the underwater propulsive device 20 is not limited to the configuration described above. In the body 21, the bow portion 31 and the barrel portion 32 may be integrally configured, for example. In terms of productivity, however, the bow portion 31, the barrel portion 32, and the stern portion 34 are preferably separate members as described above.

Although one embodiment of the present disclosure has been described above, an underwater propulsive device of a watercraft according to the present disclosure is not limited to the embodiment, and various changes may be made within the gist of the invention.

INDUSTRIAL APPLICABILITY

The present disclosure is suitably applicable to an underwater propulsive device of a watercraft including a flotation unit on which a user rides.

REFERENCE SIGNS LIST

1 watercraft
2 flotation unit
3 strut
4 water surface sensor
20 underwater propulsive device
21 body
22 motor
23 propeller
24 power transfer shaft
25 inverter (motor driving circuit)
27 first compartment
28 second compartment
29 water inlet
30 water jet outlet
31 bow portion
32 barrel portion
33 lid portion
34 stern portion
35 sealing member
38 sealing member
39 filter
43 bow hydrofoil
44 stern hydrofoil
86 coupling member
89, 90 pipes (cooling water passage)
91 suction port
92 discharge port

The invention claimed is:

1. An underwater propulsive device configured to be driven underwater, the underwater propulsive device comprising:

a hollow body provided with a first compartment in which a motor is housed and provided with a second compartment including a water passage; and a cooling water passage configured to cool the motor, at least a portion of the cooling water passage housed within the first compartment, the cooling water passage including a discharge port in fluid communication with the water passage of the second compartment.

2. The underwater propulsive device according to claim 1, further comprising:

a motor driving circuit housed in the first compartment; and wherein the cooling water passage is configured to cool the motor driving circuit.

3. The underwater propulsive device according to claim 2, wherein:

the second compartment is configured to house a propeller;

the cooling water passage of the second compartment has a water inlet and a water jet outlet; and the discharge port of the cooling water passage is configured to communicate with the water inlet.

4. The underwater propulsive device according to claim 3, wherein the water inlet is covered with a filter configured to prevent foreign matter from entering into the second compartment.

5. The underwater propulsive device according to claim 1, wherein the first compartment has a waterproof structure.

6. The underwater propulsive device according to claim 1, further comprising a motor driving circuit housed in the first compartment and interposed between the motor and a bow side of the hollow body.

7. The underwater propulsive device according to claim 1, wherein:

the second compartment is interposed between the first compartment and a stern side of the hollow body;

the second compartment includes a water inlet and a propeller; and the cooling water passage includes a suction port in fluid communication with the discharge port.

8. The underwater propulsive device according to claim 2, wherein the motor driving circuit corresponds to an inverter.

9. An underwater propulsive device of a watercraft including a flotation unit on which a user rides, the underwater propulsive device comprising:

a hollow body coupled to the flotation unit via a strut; and a hydrofoil coupled to the hollow body, and wherein the hydrofoil is configured to move based on a distance between the flotation unit and a water surface.

10. The underwater propulsive device according to claim 9, wherein the hydrofoil is configured to maintain a predetermined distance between the flotation unit and the water surface.

11. The underwater propulsive device according to claim 9, wherein the hydrofoil is configured to move upward and downward.

12. The underwater propulsive device according to claim 9, wherein the hydrofoil is coupled to a bow side of the hollow body.

13. The underwater propulsive device according to claim 9, wherein the hydrofoil is configured to reduce tilts of the watercraft in a bow direction and a stern direction during traveling of the watercraft.

14. The underwater propulsive device according to claim 9, wherein the hydrofoil is detachably attached to the hollow body.

15. The underwater propulsive device according to claim 9, wherein bow hydrofoil is attached to a bow side of the hollow body.

16. The underwater propulsive device according to claim 15, wherein the hydrofoil is detachably attached to the hollow body.

17. The underwater propulsive device according to claim 15, wherein the bow hydrofoil is configured to generate upward force by traveling of the watercraft.

18. The underwater propulsive device according to claim 17, wherein the hydrofoil is detachably attached to the hollow body.

19. The underwater propulsive device according to claim 9, wherein:

the underwater propulsive device is provided with a water surface sensor configured to measure a distance between the flotation unit and the water surface;

the water surface sensor includes a bar and a contact plate; and a front end of the bar is attached to the strut so to be rotatable upward and downward, and the contact plate is attached to a rear end of the bar.

20. The underwater propulsive device according to claim 9, further comprising a cooling water passage configured to cool a motor housed within a first compartment of the hollow body, at least a portion of the cooling water passage housed within the first compartment.

* * * * *